United States Patent [19]

Uemura

[11] 4,095,435

[45] Jun. 20, 1978

[54] METHOD OF ADVANCING A PLURALITY OF LONGITUDINALLY ARRANGED MOVABLE CONSTRUCTIONAL UNITS FORWARDLY SUCCESSIVELY IN A SELF-RUNNING MANNER AND APPARATUS FOR PERFORMING SAME

[76] Inventor: Koichi Uemura, 1-13-11, Sakura-machi, Koganei-shi, Tokyo, Japan

[21] Appl. No.: 673,052

[22] Filed: Apr. 2, 1976

[30] Foreign Application Priority Data

| | | |
|---|---|---|
| Apr. 8, 1975 | Japan | 50-41793 |
| Apr. 8, 1975 | Japan | 50-41794 |
| Oct. 4, 1975 | Japan | 50-119375 |
| Aug. 6, 1975 | Japan | 50-95014 |
| Oct. 9, 1975 | Japan | 50-121237 |
| Apr. 12, 1975 | Japan | 50-43893 |
| Oct. 16, 1975 | Japan | 50-123783 |
| Apr. 10, 1975 | Japan | 50-42779 |
| Jul. 4, 1975 | Japan | 50-81942 |
| Aug. 14, 1975 | Japan | 50-98053 |
| Aug. 14, 1975 | Japan | 50-98054 |
| Aug. 25, 1975 | Japan | 50-102094 |
| Sep. 6, 1975 | Japan | 50-107575 |
| Sep. 13, 1975 | Japan | 50-110498 |

[51] Int. Cl.[2] ..... E01G 3/00

[52] U.S. Cl. ..... 61/84; 61/42

[58] Field of Search ..... 61/84, 85, 42, 45 R, 61/63; 280/5.2; 180/8 R; 214/1 MS; 254/148; 299/11, 31–33

[56] References Cited

U.S. PATENT DOCUMENTS

| | | | |
|---|---|---|---|
| 1,948,707 | 2/1934 | Gilman | 61/84 UX |
| 3,169,376 | 2/1965 | Cunningham | 61/84 X |
| 3,234,743 | 2/1966 | Levy | 61/42 X |
| 3,613,379 | 10/1971 | Jacobs | 61/84 X |

*Primary Examiner*—Dennis L. Taylor

*Attorney, Agent, or Firm*—Toren, McGeady and Stanger

[57] ABSTRACT

A method of advancing a plurality of longitudinally arranged movable constructional units forwardly successively in a self-running manner, wherein a plurality of prefabricated constructional units for construction of an underground structure of a form adapted for a special purpose such as tunnel excavation, heavy load transportation, underwater tunnel installation or muddy water dredging excavation are arranged along a common longitudinal line adjacent to each other and are provided with a forward advancement impelling mechanism, said mechanism comprising propulsion means positioned between the successive constructional units, a linking member extending over the entire length of the combined constructional units, impelling means and anchoring means arranged at respective certain locations on said linking member, and further with the necessary engineering facilities according to the employed purpose for construction, said method comprising actuating the first propulsion means to advance the forwardmost constructional unit through the length of one stroke, releasing the first propulsion means, actuating the other propulsion means successively to advance the intermediate and tailing constructional units successively each through the length of one stroke toward the advanced forwardmost constructional unit while utilizing the reaction forces of the other stationary constructional units which are summed up by the linking and anchoring means, and repeating such a procedure of the steps constituting one cycle a number of times until the constructional units arrive at a desired site of installation.

An apparatus for performing the above-described advancing method comprising propulsion means positioned between the said successive constructional units, a linking member serving the advancement of said units and arranged to pass from the forwardmost to the tailing constructional unit therethrough, anchoring members mounted at respective certain location of said linking member, and a set of equipments necessary for the supplemental engineering purpose.

30 Claims, 74 Drawing Figures

FIG.24A
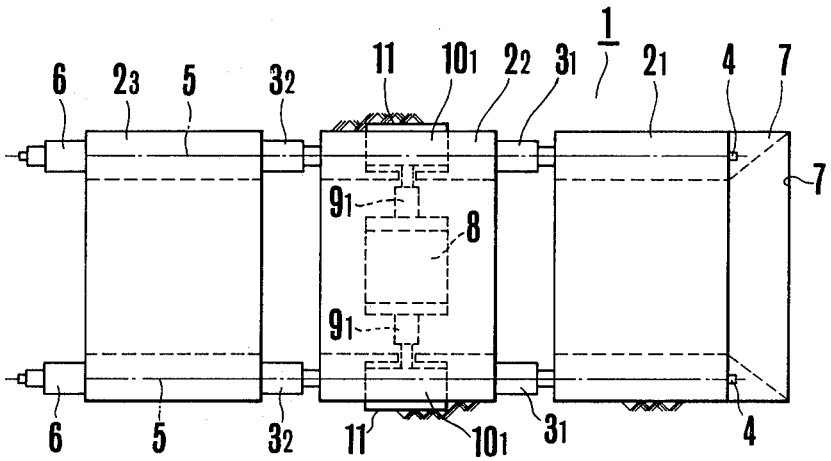
FIG.24B
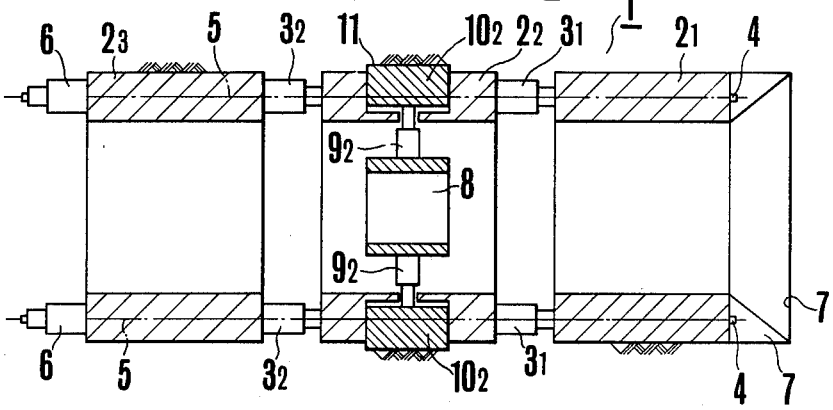
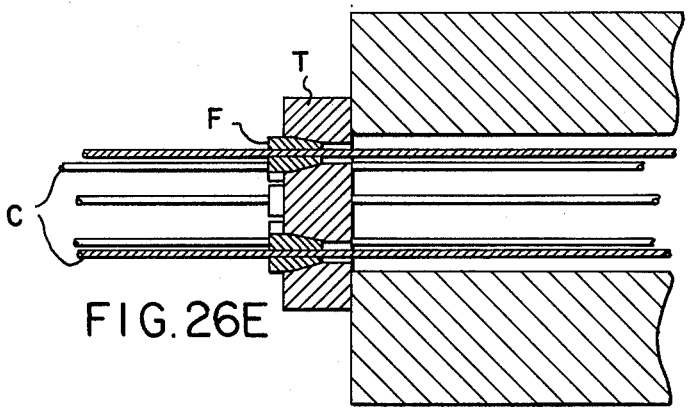
FIG.26E

FIG.24c
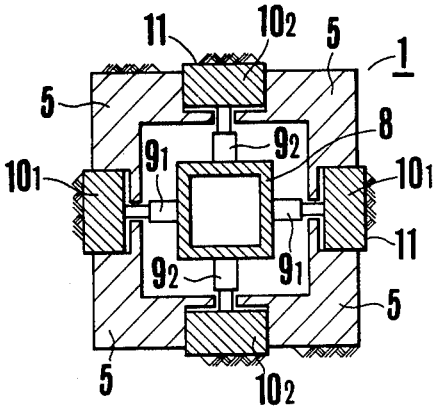
FIG.25
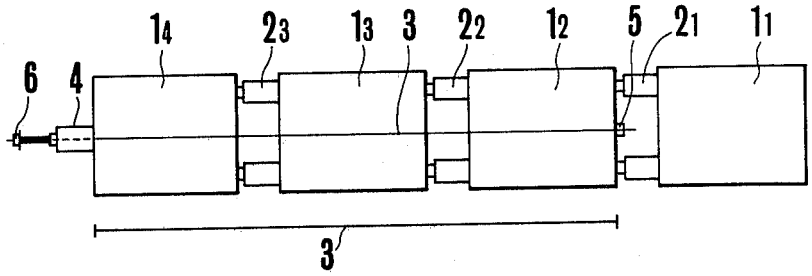
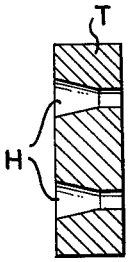
FIG.26A
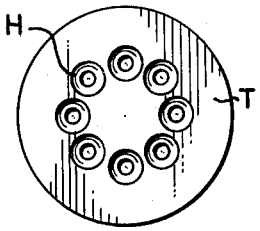
FIG.26B
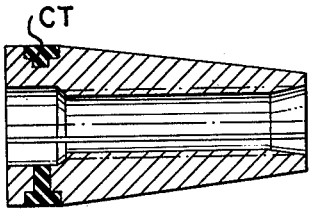
FIG.26C
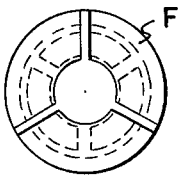
FIG.26D

METHOD OF ADVANCING A PLURALITY OF LONGITUDINALLY ARRANGED MOVABLE CONSTRUCTIONAL UNITS FORWARDLY SUCCESSIVELY IN A SELF-RUNNING MANNER AND APPARATUS FOR PERFORMING SAME

BACKGROUND OF THE INVENTION

This invention relates to a method of and apparatus for advancing a plurality of longitudinally arranged pre-fabricated constructional units for construction of an underground structure of a form adapted for a special purpose such as tunnel excavation (including galleries, passages and wells), heavy load transportation, underwater tunnel installation, or muddy water dredging excavation forwardly successively from the forwardmost through the intermediate to the tailing constructional unit relative to the others and relative to the ground in a self-running manner.

Of the above mentioned purposes, the heavy load transportation, for example, has been practiced in the prior art at an increased high speed while sacrificing the safety operation with the result of frequent occurrence of serious accidents, as the maintenance of safety operation leads to economic disadvantages due to the decrease in the transportation efficiency. In other words, increasing transportation speeds are ultimately to be realized by employment of high power driving machines which increase the probability of occurrence of large-scale terrible accidents.

In driving a tunnel (including underground excavations such as galleries, passages and wells), it has been the prior art practice to employ machines for picking and hauling away the spoil to disposal at a high efficiency. Each time an explosive charge is shot, however, a large amount of spoil-fly is generated and the working area must be cleared of operators and equipments thereby the effectiveness of employment of the machines is diminished. The extension of the railway for the working tractors requires so much labor and time, and moreover, it is difficult to lay the rail near to the spoil-picking place, thereby the total run of excavation is caused to associate with various drawbacks and the desired continuous and time saving operation can not be performed so that such a prior art method is rendered uneconomical. In order to eliminate the above mentioned problems, the provision of working platforms has so far been made to clear the area of the operators with the result that the effectiveness of employment of the machines is increased. The necessary facilities require an added large expense which is an avoidable disadvantage of the prior art.

As a method of excavating a gallery according to the prior art, it is known to operate a plurality of constructional units in such a manner that two constructional units are selected as separated apart from each other and opposedly disposed to each other, then one of the two units is advanced toward the other by use of a mechanism comprising a traction jack, a traction member and anchoring members, these parts being arranged to create a reaction force at the selected one of the two constructional units which can be utilized to advance the other constructional unit relative to the ground, then after the latter constructional unit has been advanced, the former one is advanced by utilizing the reaction force created at the latter by the mechanism. With this arrangement, however, the traction force of the traction jack, because of its application only to the individual constructional units, is limited in effect. Moreover, the traction force is rendered effective when the reaction force of the opposite side constructional unit is utilized as the reaction force therefor, so that each time the advancing operation is transferred from one to another constructional unit, the reaction force must be renewed between the successively paired constructional units. The expense to creating this new reaction force amounts up to a very large level.

For installation of an underwater tunnel at a desired site, according to the prior art, a foundation on which the tunnel structure is to be installed is prepared in a flat form or in a grooved form, then the entire tunnel structure is divided into a suitable number of constructional units which are prefabricated on the land, then these constructional units are transported one by one on water by ships or by towing under the self-buoyant action to a location just above the site of installation, then they are sunk into the bottom of the water body at which the individual constructional units are jointed with each other to construct the installation of a single tunnel structure.

Such a prior art sunk-installation method, however, is very much susceptible to weather conditions and is associated with a considerably low rate of operation per year. Another disadvantage is that the transportation of the individual constructional units on land and on water, and the sinking operations thereof require large-scale various equipments and a large amount of expense therefor. In addition thereto, it is necessary to take into account the passage of ships having no relation to the transportation of the constructional units and travelling near the spot. Further, it is very difficult to sink the individual constructional units accurately from the water surface to the installation site on the bottom of the water body.

In the case of the construction of an underground structure in a water pressure-acting ground, according to the prior art using a compressed air in preventing seepage flow of water and cave-in of the ground, the compressed air producing equipment is positioned outside the underground structure, namely on the land, as separated from the air pressure buffering chamber by a large distance. As the excavation proceeds, therefore, the air pressure buffering chamber advances forwardly, while leaving the compressed air producing equipment stationary behind, thereby the distance therebetween is increased which in turn calls for an increase in the length of the interconnection pipe means between the air pressure buffering chamber and the compressed air producing equipment. This requires complicated operations and large labor and time with a large amount of expense. Furthermore, the installation of the compressed air producing equipment chamber requires a large area of the ground, thereby giving an additional disadvantage of increasing the cost of production of the underground structure installation due to the difficult negotiation for securing the site, the additional expense therefor, and a considerably elongated period of the preparatory and installation operation. Further, when the installation site of the compressed air production chamber is located near a populated area, some elaborate and expensive precautions must be made or otherwise the extensive noise would give rise to complaints. For example, the provision for shielding the noise of the compressed air producing chamber, or of an underground room for accommodation of it. Furthermore, as the interconnection pipe lines for transporting the compressed air are increased in length, their installation, operation and maintenance are very disadvantageous from the economical, operation efficiency and safety standpoints.

In the case of the construction of an underground structure in a relatively soft sandy ground, according to the prior art, a water jet is applied to the excavating surface of the tunnel, and the spoil is converted to a muddy water body which is pumped out onto the land, and the settling operation is performed by use of various means, thus excavating operation is carried out while the muddy water body being separated into water and soil.

Such a prior art excavating method has various disadvantages, one of which is that the transportation of a large amount of muddy water from the excavating spot to the land through a number of pipes of long length causes frequent occurrence of blockages in the pipes by the solidified muddy water body passing therethrough and another disadvantage which is that a large number of settling vessels of large volume are necessary which in turn calls for a large area for the site of its installation. Another disadvantage is that the amount of material of the pipes weared out by the passage of the muddy water therethrough is very large which leads to an increase of the percentage of damaged pipes Still another disadvantage is that when the current of the muddy water is stopped in order to interchange the damaged pipe by a new one, or to extend the pipe line by addition of new pipes, the frequency of occurrence of pipe blockages is increased because the soil particles in the muddy water body is liable to deposit.

The water necessary for converting the spoil into a muddy water body is transported from the land to the excavating spot, and further in general the muddy water chamber and various equipments necessary for the excavation are provided as separated from the underground structure body but as arranged outside thereof as a temporary structure body. This temporary structure body must be constructed in so rigid a form that it can withstand against the very strong pressure of water and this requires a very large expense. After the construction of the underground structure has been completed, this temporary structure body must be removed and transported onto the land, and this also requires a very large amount of expense.

In driving a tunnel, a plurality of constructional units for construction of an underground structure are arranged along a common longitudinal line, and all the individual constructional units are interconnected by a common linking member and advanced individually subsequently from the forwardmost to the tailing constructional unit relative to the others and relative to the tunnel ground in a self-running manner while utilizing as a reaction force the sum of the frictional forces of the other stationary constructional units against the part of the tunnel wall which is usually the bottom of the tunnel wall when the tunnel is excavated in a hard ground. These frictional forces have at random magnitudes so that so far as the reaction force is derived from only these frictional forces, the forwrd advancement of the constructional units relative to the tunnel ground is made different in one step distance from one unit to another, or almost impossible.

Further taking into account the resistance force necessary to locate the forwardmost constructional unit with a cutter at the front thereof in position for excavating the hard rock of the front face of the tunnel, and to haul away the spoil accumulated in front of or in rear of the cutter, it is impossible to achieve the perfect forward advvancement of the individual constructional units inasmuch as only the uncertain frictional resistances of the bottom walls of the ones of the constructional units which remain stationary during the advancement of the selected one constructional unit and at random small frictional resistances of the upper and side walls thereof are utilized as the reaction force for the advancement of the selected one constructional unit.

SUMMARY OF THE INVENTION

An object of the present invention is to provide a method of advancing a plurality of longitudinally adjacently arrranged prefabricated underground structure constructional units for use as an excavator of a tunnel (including gallery, passage and well) one by one while causing the production of reaction forces at the other stationary constructional units without causing the production of reaction forces at the other things besides the above mentioned individual constructional units, and to provide an apparatus for advancing a plurality of underground structure constructional units comprising a linking member arranged to pass through all the longitudinally arranged constructional units, means for advancing the linking member mounted at the front face of the forwardmost constructional unit having a cutter, anchoring members for said linking member arranged on the respective intermediate and tailing constructional units, and propulsion means arranged between the adjacent constructional units.

In the above-described advancing apparatus, the advancing means mounted at the front face of the forwardmost constructional unit and the anchoring member mounted at the rear face of the tailing unit may be replaced by each other with the result that the anchoring member is mounted at the front face of the forwardmost constructional unit and the advancing means is mounted at the rear face of the tailing constructional unit. With such a modified apparatus, it is possible to advance the underground structure constructional units in a self-running manner by the above-described advancing method.

As another example of the above-described advancing method and apparatus, instead of using the cutter as mounted in the forwardmost constructional unit, it is possible to use a separate cutter as arranged independently of the forwardmost constructional unit. In this case, the advancing method and apparatus are comprised as follows; between a support member for supporting the independent cutter and the forwardmost constructional unit and between the successive constructional units are respective propulsion means, the linking member, passing from the cutter-supporting member to the tailing constructional unit, is provided with a bracing-and-advancing mechanism having propulsion or traction means mounted at one end of the linking member and with an anchoring member mounted at the other end thereof; with this arrangement, the first propulsion means between the cutter-support member and the forwardmost constructional unit is operated to advance forwardly the cutter relative to the forwardmost constructional unit, then the first propulsion means is released, then the bracing-and-advancing mechanism is operated to brace the linking member to the cutter and the tailing contructional unit, then the second propulsion means betwen the forwardmost and the next constructional unit is operated to advance forwardly the forwardmost constructional unit toward the cutter and relative to the second constructional unit, then such a procedure is repeated to advance forwardly all the intermediate constructional units individually successively, and finally the brace-and-advancing mechanism is operated to advance forwardly the tailing constructional unit through the linking member.

According to the above-described method, there is an advantage that a large-scale largely elongated prefabricated underground structure can be advanced forwardly to a desired site of installation by use of simple apparatus and operation procedure. In advancing the cutter followed by the individual constructional units, the frictional resistances of the stationary cutter or other constructional units against the environmental ground surface can be summed up and utilized as a source of producing reaction force for the advancement of the moving cutter or moving one of the constructional units. Accordingly, there is no need to provide additional reaction force-producing wall members which assist in the traction or propulsion of the cutter or that one of the units which is selected for advancement, thereby giving an advantage of simplifying the advancing apparatus and of contributing to the reduction of the term of works. Moreover, the advancing method of the invention provides so-called "One Side Work", eliminating the so-called "Two Side Work" which might be otherwise employed as in the prior art particularly when the underground structure is of extremely large scale. For this reason, the amount of necessary equipment and labor can be almost halved. Further, the method of the invention does not necessitate the use of traction members as arranged between the opposite two parts of a large-scale underground structure in the Two Side Work, the provision of the horizontal tunnel boring for insertion of the traction members, or of the previous construction of a guiding tunnel, and further any particular prop system for the tunnel excavation, as the train of the constructional units is perfect in structure at any time and at any location during their step-by-step advancement. Furthermore, while hauling away the soil material cut out by the cutter, the advancement of the underground structure can be continued to result in a decrease of the time for the installation of the underground structure at the predetermined site.

Another object of the invention is to provide a method of and apparatus for advancing a plurality of longitudinally adjacently arranged transportation structure constructional units forewardly to transport very heavy loads.

This method is performed with an embodiment of this apparatus, said apparatus comprising a linking member arranged to pass through all the individual transportation structure constructional units each of which is comprised of a heavy load carriage and advancing means and which are arranged along a common longitudinal line adjacent to each other to be moveable in one direction, and dismountable anchoring members arranged at the respective ends of the linking member, in such a manner as comprising the steps of: actuating the advancing means of the forwardmost construction unit to advance the forwardmost constructional unit forwardly relative to the others and relative to the ground through a distance of transportation of one stroke, releasing the said advancing means, actuating the advancing means of the second constructional units counting from the front to advance the second constructional unit forwardly toward the forwardmost constructional unit by the same distance of transportation of one stroke, releasing the second advancing means, and subsequently individually actuating the advancing means that follow the second advancing means to advance the other constructional units forwardly successively from the front to the rear each by the same distance of transportation of one stroke, thereby after one cycle of the steps has been completed, the constructional unit group as a whole is advanced forwardly relative to the ground by the distance of transportation of one stroke.

According to the above-described transporting method, when any one of the constructional units is advanced, regardless of its location in the train, the reaction forces produced at the other stationary constructional units can be summed up by the linking member cooperating with the anchoring member mounted at the front and rear ends thereof in a manner to establish an organically correlated train of the self-runningly movable transportation system, whereby the summed reaction forces can be utilized in the advancement of the selected one of the constructional units. Therefore, the organic, efficient, economic and continuous transportation of a large number of heavy load at a time can be achieved through a desired length of distance of transportation, though the transportation speed is somewhat slow. Further, the transportation apparatus is simple in structure as compared with the conventional transporting apparatus using motor-driven machines, because of the use of jacks or equivalent means thereto with minimized possibility of occurrence of accidents. Thus, the apparatus of the invention has a maximum advancing capability and can transport huge materials with safety and steadily.

In the above-described apparatus, any one of the constructional unit which is selected for the advancement can be readily adjusted in advancement orientation by its advancing means, as the other stationary constructional units serve as an anchorage for the linking member through which their reaction forces can be utilized in advancing the selected one of the constructional unit. When a danger is recognized during the advancement, the impelling action can be immediately stopped at the time to insure the safety transportation.

Still another object of the invention is to eliminate the drawbacks of the conventional method of installation of underwater tunnel by the sinking and to provide a method of and apparatus for installing an underwater tunnel at a desired site to which a group of pre-fabricated constructional units for construction of an underwater tunnel is advanced on a foundation under water in a self-running manner from the land by the remote control, while permitting the entrance of water into the interior of the constructional unit group.

A further object of the present invention is to provide a method of and apparatus for constructing an underground structure from prefabricated constructional units with safety in a water pressure-acting ground, while preventing the gushing out of water from the front excavating face or the cave-in of the excavating face.

A still further object of the present invention is to provide a method of and apparatus for constructing an underground structure in a relatively soft sandy ground by employing the underground structure advancing method as described in the above mentioned various objects of the invention and as combined with a novel muddy water excavation advancing method.

Another object of the invention is to provide a method of and apparatus for advancing a constructional unit group for construction of an underground structure in a hard ground while excavating at a high efficiency and with safety and steadily.

A further object of the present invention is to provide a method of and apparatus for advancing a constructional unit group for construction of an underground structure by the use of a guiding tunnel and an opposite side constructional unit toward each other.

In the following, the present invention is further illustrated in connection with the specific examples of the embodiments of the method and apparatus according to the present invention by reference to the accompanying drawings.

BRIEF DESCRIPTION OF THE DRAWINGS

The accompanying drawings show embodiments of the method of the present invention as applied to various construction purposes.

FIG. 1A is a longitudinal sectional view of an example of the above mentioned method in which the traction jack and anchoring member mounted on the head and tail constructional units of FIG. 1 respectively are replaced with each other. FIGS. 2A to 5A which will correspond to FIGS. 2 to 5 are omitted for the purpose of saving paper space, but may be considered to show a process similar to that shown in FIGS. 1 to 5.

FIGS. 1B to 3B are longitudinal sectional view of a modification of the example of FIGS. 1 to 5 in which the head constructional unit having a cutter is replaced by an independent cutter with a propelling jack located between the cutter and the foremost constructional unit, and showing one step advancement of the unit group wherein one cycle of the advancement process is similar to that shown in FIGS. 1 to 5.

FIGS. 1C to 3C are longitudinal sectional views wherein the cutter mounted in front of the foremost constructional unit of FIGS. 1B to 3B is replaced by a separate slidable cutter mounted in a movable support frame and showing a one-step advancement of the unit group wherein the advancement process is similar to that shown in FIGS. 1 to 5.

FIGS. 9A to 9F show the details of the structure of an apparatus usable in the above mentioned process, wherein FIG. 9A is a top view of the apparatus, FIGS. 9B and 9C are longitudinal sections taken along the line A—A and the line B—B of FIG. 9A respectively, and FIGs. 9D, 9E and 9F are transverse sections taken along the line C—C, the line D—D and the line E—E of FIG. 9A respectively. FIGS. 10 and 11 show the details of the structure of the platform car as a constructional unit at a region near the connection between two successive cars, wherein

FIGS. 24A, 24B and 24C are top, longitudinal sectional and transverse sectional views respectively of an example of an apparatus for use in the method of advancing an underground structure in a hard ground by excavation with safety and reliability according to the invention.

FIG. 25 is the top view of a modification of the present invention in which the linking member is shifted backward when additional construction unit is added.

FIGS. 26A–26E show various views of the anchoring members illustrated schematically in FIGS. 1–5.

DESCRIPTION OF THE PREFERRED EMBODIMENTS

EXAMPLE I

Figure 1:
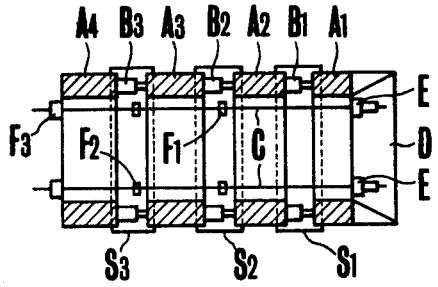
FIGS. 1 to 5 are longitudinal schematic views showing a process for advancing a group of constructional units for construction of an underground structure successively in a self-propelled manner employing the method of the present invention, and wherein the illustration of skirt members is omitted in FIGS. 2 to 5.

The method of advancing an underground structure in a self-running manner according to the present invention will next be explained in detail in connection with the preferred embodiments shown in the drawings.

In FIG. 1, there are shown four constructional units for construction of an underground structure which are designated $A_1$, $A_2$, $A_3$ and $A_4$ with the subscripts being numbered consecutively from the head to the tail, as arranged adjacent to each other along a common advancement line. The units $A_1$, $A_2$ and $A_3$ are provided with respective skirts $S_1$, $S_2$ and $S_3$ fixedly mounted thereon and rearwardly extending to such an extent that when the units are advanced individually in succession the gap produced between two adjacent units is covered by the respective skirt as the skirt is moved in sliding relation along the outer periphery of the respective next-following units. Positioned between the adjacent units are propellent jacks $B_1$, $B_2$ and $B_3$ each in one space intervening the two. There are further provided linking members C for advancement made of PC steel material arranged to pass through all the individual constructional units $A_1$ through $A_4$. At the front of the foremost constructional unit $A_1$ having a cutter D, there are shown traction jacks E arranged to cooperate with the linking members C. On the linking members C are, as their anchoring members, mounted cones $F_1$, $F_2$ and $F_3$ at locations coincident with the rear end surfaces of the individual constructional units $A_2$, $A_3$ and $A_4$ respectively in mounted in fixed relation to the linking members C. Each of the anchoring members as shown in FIGS. 26A–26E is formed of an anchor plate T made of a special steel and containing a plurality of small holes H disposed in annular arrangement about the center of the anchor plate. Each hole has a frusto-conical shape tapering inwardly toward the head end of the constructional unit. The anchoring action between the plate T and the linking member C is effected over cones or wedges $F_1$, $F_2$ and $F_3$ also of frusto-conical shape which fit into the holes H. The cones or wedges are hollow and their inner surfaces are roughened for easy engagement with the linking members C which extends through the cones and the plate. The cones or wedges are formed of two or more pieces and are held together by a rubber ring (CT).

During operation the cones $F_1$, $F_2$ and $F_3$ to be used in providing the anchoring action are loosely inserted into the small holes H in the anchor plate with the linking members C extending through the cones. When the linking members are pulled forwardly by the traction jacks E, the cones, due to their roughened surfaces in engagement with the linking members C, are pulled into the holes H by the linking member establishing a locking engagement with the anchor plate T which bears against the respective constructional unit. The stronger the pull exerted on the linking members C, the stronger is the locking engagement of the wedges or cones in the holes of the anchor plate. Removal of the cones from the anchor plates is effected by a reverse pulling action on the linking members C which then releases the cones from the holes in the anchor plate.

In operating the apparatus of such construction and arrangement to perform the above mentioned method, the traction jack E is at first set to a free or released position where no fixing pressure is applied to the linking member C and exerts no traction force, and at the same time all the cones $F_1$, $F_2$ and $F_3$ are brought into the free state relative to the linking member C. After that, the propellent jack $B_1$ positioned between the constructional units $A_1$ and $A_2$ is operated to advance the foremost constructional unit $A_1$ relative to the second unit $A_2$.

Figure 2:
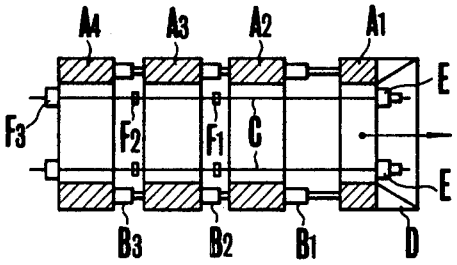

At this time, as shown in FIG. 2, the advancement of the constructional unit $A_1$ relative to the ground can be secured by the sum of the reaction forces of the other constructional units $A_2$, $A_3$ and $A_4$, as the sums of the lengths and weights of these units $A_2$, $A_3$ and $A_4$ amount up to 2 or 3 times those of the length and weight of the foremost unit $A_1$, so that it is possible to insure that the unit $A_1$ is reliably provided with its propulsive reaction force to achieve smooth advancement.

Figure 3:
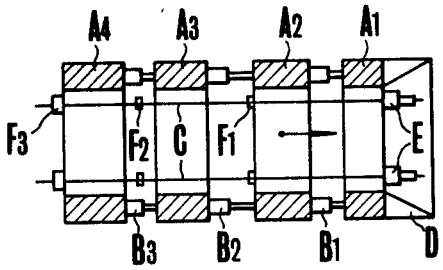

In FIG. 3, after the propellent jack $B_1$ is released to the free state, the cone $F_1$ is set in the fixed relation with the linking member C so that it serves as an anchoring member for the second constructional unit $A_2$. Next, the traction jack E is set to the fixed position, causing said constructional unit $A_1$ to afford a reaction force for attraction of the second unit $A_2$, and, in synchronism with operation of the traction jack E, the propellent jack $B_2$ positioned between the above mentioned unit $A_2$ and the unit $A_3$ adjacent the unit $A_2$ is operated, while causing the other units $A_3$ and $A_4$ to afford a propelling reaction force, to advance the said unit $A_2$ relative to the third unit $A_3$ but toward the first unit $A_1$ under the action of the combined attractive and propulsive forces as the reaction forces of the units $A_1$, $A_3$ and $A_4$ are summed up to achieve smooth advancement relative to the ground.

Figure 4:
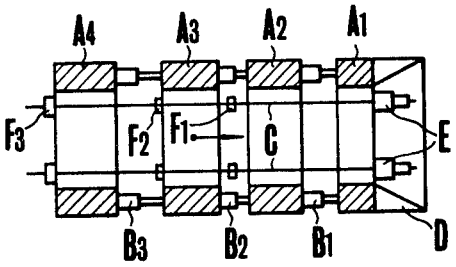

Further, in a manner similar to that shown above in connection with the above mentioned advancement step, as shown in FIG. 4, the third constructional unit $A_3$ is advanced.

Figure 5:
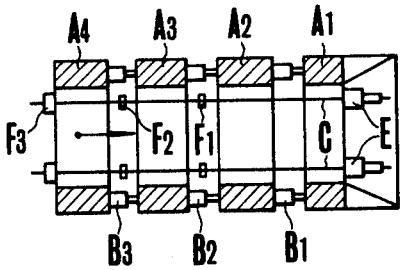

In FIG. 5, the propellent jack E is released to the free state, and the cones $F_1$ and $F_2$ are loosened. After the above mentioned linking member C is anchored to the rearmost or tail constructional unit $A_4$ by making use of the cone $F_3$, the propulsion jack E is operated, causing the said constructional unit $A_4$ to advance by utilizing the summed reaction forces of the other constructional units $A_1$, $A_2$ and $A_3$. As a result, all the units $A_1$ through $A_4$ have advanced to complete one cycle of operation steps.

The above mentioned advancement procedure repeats itself until the underground structure reaches the desired location under the ground.

The excavating and hauling-away operation may be carried out by conventional methods, and, therefore, their explanation is omitted.

In FIG. 1A, there is shown an apparatus different from that of the above mentioned example I in that the traction jack E provided at the cutter section D of the foremost constructional unit $A_1$ is changed in position to the rearmost constructional unit $A_4$, and the anchoring member $F_3$ provided at said unit $A_4$ is changed in position to the cutter of the above mentioned unit $A_1$. With such an arrangement, it is possible to reduce the working difficulty in operating the large scale traction device near the cutter to the degree depending upon the working environment, thereby giving an advantage of improving the efficiency of operation. Further, the excavating, stocking and hauling-away operations can be continuously performed. Moreover, it is possible, though the place near the cutter is dangerous and narrow because of the high probability of occurrence of degradation, to perform the operation with ease and safety as the anchoring member located in this place is of small scale. This aspect, particularly in the case of underwater construction, has an advantage of removing the labour of the diver for controlling the operation of the traction device.

Figure 2B:
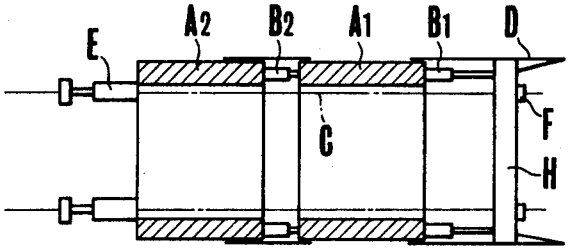
Figure 3B:
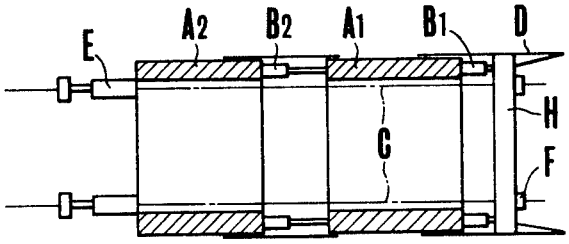

FIGS. 1B, 2B and 3B show an apparatus in which instead of arranging the foremost constructional unit $A_1$ having the cutter D, an independent cutter D is firmly supported on its supporting member H, behind the cutter D are two constructional units $A_1$ and $A_2$ slidably engaged with each other in a common longitudinal direction, between the cutter D and the constructional units $A_1$ and $A_2$ are respectively located propulsion jacks $B_1$ and $B_2$, and between the cutter supporting member H and the tail constructional unit $A_2$ is a linking member C having a propulsion jack serving as the fixture advancing facility E and an anchoring member F arranged at the either end thereof. The protection skirt S is arranged between the two constructional units $A_1$ and $A_2$ to serve for prevention of occurrence of soil degradation, and is so constructed that said $A_2$ is slidably movable for advancement inside the skirt S. The process for advancing the above mentioned constructional unit group is identical to that described in connection with the above mentioned apparatus, and therefore its explanation is omitted.

Further, the above mentioned fixture advancing facility E and the anchoring member F may be changed in position as replaced by each other without producing a difference in working effect, and, therefore, its explanation in connection with the drawings is omitted.

Figure 2C:
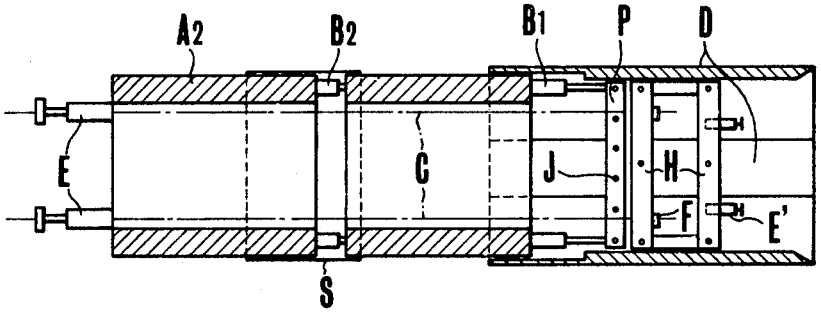
Figure 3C:
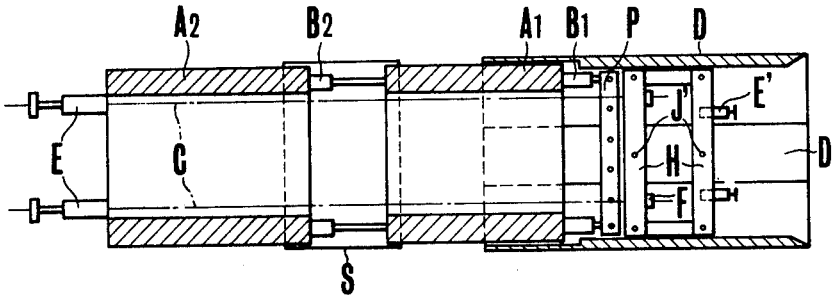

FIGS. 1C, 2C and 3C show an example of modification of the above mentioned apparatus. At the front, there is shown a cutter D which is divided in portions having various cross-sectional configurations and arranged around the periphery of a movable support frame H having a ground support jacks E', so that the divided portions of the cutter D can be movable relative to each other by a linking mechanism when it advances. Behind the cutter, there are shown constructional units $A_1$ and $A_2$ arranged to be slidably movable relative to each other. There are provided propulsion jacks $B_1$ and $B_2$ located between $A_1$ and the cutter D and between $A_1$ and $A_2$, respectively, so that when said propulsion jacks $B_1$ and $B_2$ are operated, the divided cutter D, the movable support frame H and the foremost constructional unit $A_1$, these three parts can be individually advanced. There are further provided linking members C arranged as passing through the apparatus between the movable support frame H and the tail constructional unit $A_2$ and provided with a fixture advancing facility comprised mainly of propulsion or traction jacks at one end thereof, the opposite end of which carried cones F as the anchoring member to serve as a reaction force wall when the foremost constructional unit $A_1$ is advanced by the propulsion jack $B_2$ while the above mentioned support frame and constructional unit $A_2$ are fixed and tensioned relative to each other. At first, the joint member J located between the pushing member P mounted in front of the propulsion jack $B_1$ and the divided cutter D is rendered ineffective, and then the propulsion jack $B_2$ is operated to advance only the divided cutter D with the entire integral periphery individually divided through the length of one stroke, while the cutting face is depressed by the ground support jack E' provided in front of the movable support frame, relative to the constructional units $A_1$ and $A_2$ and also to the ground under the action of the reaction forces of $A_1$ and $A_2$ (see FIG. 2C). Next, as shown in FIG. 3C, the joint member J' between the movable support frame H and the divided cutter D is set to the active position, and then the propulsion jack $B_2$ is operated to advance the constructional unit $A_1$ through the length of one stroke of excavation while the movable support frame H affixed to the cutter D and the tailing constructional unit $A_2$ are fixed relative to each other through the linking member C by the above mentioned bracing-and-advancing facility E, thereby the sum of the frictional forces exerted by the soil pressure on the peripheries of all of the cutter and the tail constructional unit $A_2$ other than the foremost constructional unit $A_1$ are utilized to afford the reaction force for the advancement of the said constructional unit $A_1$ relative to the ground.

Next, in order to advance the constructional unit $A_2$, the procedure similar to that mentioned above may be employed; and this and that procedures repeat themselves in sequences to achieve infinite length of advancement.

Further, the bracking-and-advancing facility E and the anchoring cone F in this apparatus may be arranged in longitudinally opposite relation to that shown above without causing any difference in the efficiency.

EXAMPLE II

Figure 6A:
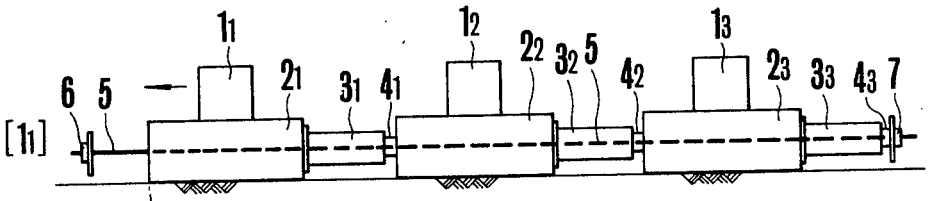
FIGS. 6*a* to 6*d* are side views showing an example of a device composed of a plurality of unit constructional bodies usable in a heavy load transporting method according to the invention, and showing the first and second steps of a process for its transporting operations.
Figure 6B:
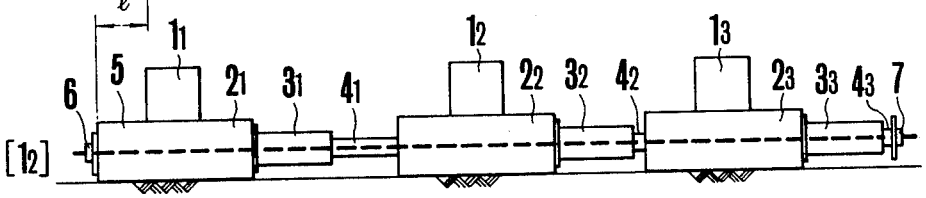
Figure 6C:
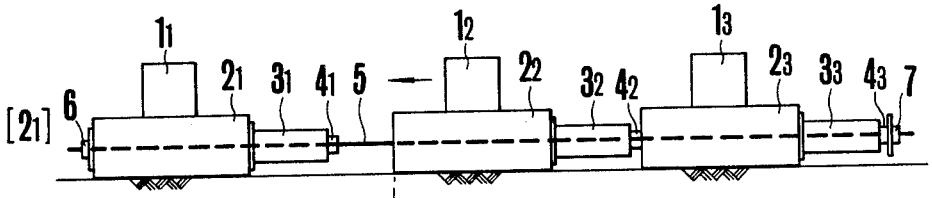

FIGS. *6a* to *6d* are side views of an example of a train of transportation apparatus according to the present inventon as applied to the transportation of heavy load, showing respective steps of a process for advancing the train of transportation apparatus through the length of one stroke ($l$) in sliding relation on the road based on the constructional unit group advancing method of the present invention, said apparatus comprising carriages $2_1$, $2_2$ and $2_3$ carrying thereon respective heavy loads $1_1$, $1_2$ and $1_3$, impelling devices $3_1$, $3_2$ and $3_3$ detachably mounted on the respective carriages 2, a linking member 5 arranged to pass through all the carriages 2, and anchor members 6 and 7 mounted on the respective ends of the linking member 5. FIG. 6*a* shows a state in which the preparation for transportation of the apparatus is made ready. A jack composed of main body $3_1$ and piston $4_1$ is used as impelling device. When the jack $3_1$ is operated, the piston $4_1$ is set to push the following carriage $2_2$ and further through the other impelling device $3_2$, $4_2$ to push the carriage $2_3$. As the frictional force of the carriage $2_1$ is smaller than the sum of the frictional forces of the carriages $2_2$ and $2_3$, the carriage $2_1$ is advanced by a distance ($l$) of one stroke relative to the carriages $2_2$ and $2_3$ and to the road under the action of the summed reaction forces of the carriages $2_2$ and $2_3$. FIG. 6*b* shows a state of completion of one step advancement. FIG. 6*c* shows a state of the impelling device $3_1$ released.

Figure 6D:
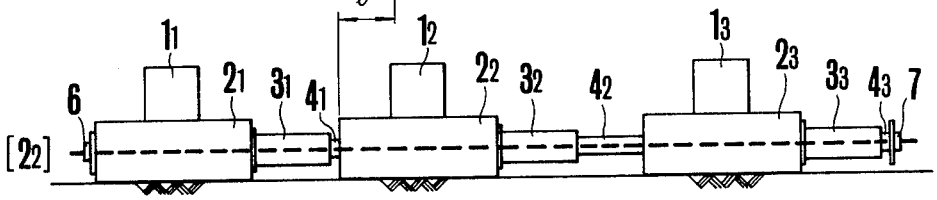

When the impelling device $3_2$ is next operated, the piston $4_2$ pushes the carriage $2_3$, thereby a portion of the propulsive force is acted on the anchor member 7 through the impelling device $3_3$, and therefrom further transmitted to the linking member 5 in which it is converted to a tension which is acted on the carriage $2_1$ as a retractive force through the anchor member 6. As a result, the frictional forces of the carriages $2_3$ and $2_1$ against the road surface are summed up to an amount larger than that of frictional force of the carriage $2_2$, so that the carriage $2_2$ is advanced relative to the road. The state of completion of this step advancement is shown in FIG. 6*d*.

The next step of operation for advancement though not illustrated in the drawings can be achieved in a manner such that the impelling device $3_2$ is released and then the impelling device $3_3$ is operated to cause the piston $4_3$ to push the anchor member 7 which in turn causes the tension of the linking member 5 in a manner to that shown in connection with the above mentioned operation which is transmitted through the anchor member 6 to the carriage $2_1$ and therefrom further through the impelling device $3_1$ to the carriage $2_2$, thereby the carriages $2_1$ and $2_2$ exert an attractive force for the carriage $2_3$. As a result, the carriage $2_3$ is advanced under the action similar to that shown above, that is, the summed reaction forces of said $2_1$ and $2_2$ by a distance ($l$) of one stroke.

Such a procedure repeats itself until the heavy loads are transported to the desired location. The number of transportation structure units, each comprising a carriage 2 and an impelling device 3, may be increased according to the need.

Figure 7A:
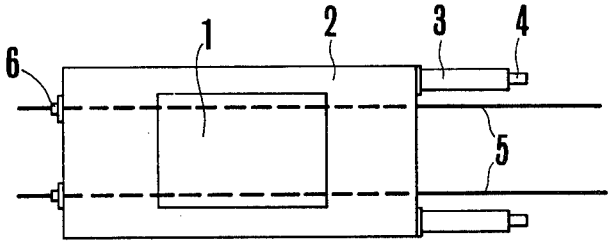
FIGS. 7*a* and 7*b* are respectively top and side views of the foremost structure unit of FIG. 6.
Figure 7B:
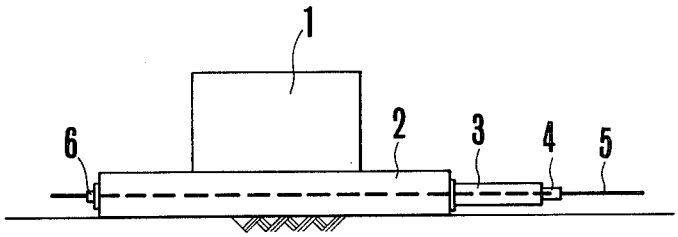

FIGS. 7*a* and 7*b* are respectively top and side views of one transportation structure unit composed of a carriage 2 and an impelling device 3 detachably mounted on the carriage 2. For employment as said impelling device, a jack is selected as an example, the reference numeral 3 denoting the jack and numeral 4 denoting a piston of the jack 3. This impelling device is shown as having a pair of jacks arranged near the respective side edges of the rear surface of the carriage for the purpose of adjusting the advancement direction.

Figure 7C:
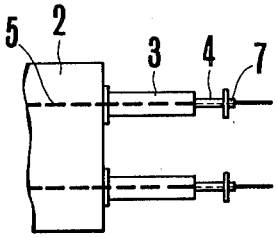
FIGS. 7*c* and 7*d* are fragmental top views of the advancing drive section of the rearmost structure unit of FIG. 6 wherein the number of linking members is equal to or different from that of jack elements respectively.
Figure 7D:
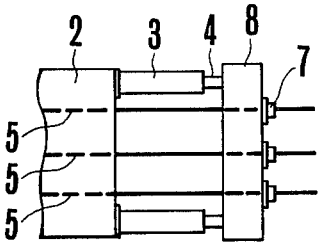

FIGS. 7*c* and 7*d* are top views in enlarged scale of the impelling device provided on the tailing transportation structure unit and shown as somewhat different from each of the other units in construction and arragement. In FIG. 7*c*, the linking members and jacks are equal in number to each other, and the jacks 3 with their pistons 4 are of the hollow core type, thereby it is being made possible to arrange the anchor members 7 at the rear ends of the respective pistons 4. FIG. 7*d* shows a case wherein the numbers of the above mentioned both members are different in number from each other, and there is provided a reaction force receiver 8 arranged between the pistons 4 and the anchor members 7 to transmit force therebetween.

EXAMPLE III

This example is a modification of the embodiment of the heavy load transporting method shown in Example II and is shown in connection with a process for advancing a train of platform cars in a tunnel and for laying rails by employing the method of advancing a plurality of constructional units in a self-running manner according to the present invention.

FIGS. 8*a* to 8*e* show the successive steps of the process for advancing the platform cars while laying rails. As the constructional units arranged along a common line, there are shown three working platform cars $1_1$, $1_2$ and $1_3$, between them jacks $2_1$ and $2_2$ are respectively located. Beside these jacks, there is provided an additional jack of hollow core or full core type mounted on the forewardmost or tailing platform car. In the above mentioned drawings, this additional jack $2_3$ is shown as mounted on the rear end of the tailing platform car $1_3$.

A linking member 3 is arranged to pass through all the cars and is provided with anchor members $5_1$ and $5_2$ mounted at the respective end thereof, so that the cars $1_1$, $1_2$ and $1_3$, the jack $2_3$ and the linking member 3 are organically interrelated with one another.

The platform cars $1_1$, $1_2$ and $1_3$ fixedly carry thereon respective rails $6_1$, $6_2$ and $6_3$, the rails $6_3$ being normally connected to the laid rails 7 through special interconnection rails 8 in sliding engagement with each other. With this apparatus, two of newly laying rails 9 previously stored in the chamber of the tailing platform car $1_3$ are extracted and moved to a location at which the extracted rails 9 are set in end-to-end relation to the previously laid rails 7 as shown in FIG. 8*b* and then fixedly connected thereto.

Next, the jack $2_1$ is operated to propel the forwardmost car $1_1$ through its piston. In this case, the frictional force of the car $1_1$ against the levelled slide surface of the bottom of the tunnel is smaller than the sum of frictional forces of the cars $1_2$ and $1_3$ so that the car $1_1$ is slidingly advanced on the levelled slide surface under the action of a reaction force equal to the sum of the reaction forces of the other cars $1_2$ and $1_3$ by a distance ($l$) of one stroke. therefore, the split between the cars $1_1$ and $1_2$ thereby formed is extended to a length equal to the length ($l$) of one stroke. For this reason, on the protection sleeve $10_1$ mounted at the rear end of the car $1_1$ by hinged structure is special interconnection rails $12_1$ fixedly mounted thereon and arranged to interconnect the platform rails $6_1$ and $6_2$ of the cars $1_1$ and $1_2$. Therefore, as shown in FIG. 8c, as the car $1_1$ advances forwardly, the above mentioned protection sleeve $10_1$ and the special interconnection rails $12_1$ are simultaneously advanced forwardly while still maintaining the over-lapping of the protection sleeve $10_1$ on the next car $1_2$ to cover the above mentioned split thereby formed between the adjacent cars.

The next operation is to release the jack $2_1$ and to actuate the jack $2_2$ of which the piston propels the car $1_2$. This propulsive force is acted on as a reaction force for the tailing car $1_3$, and further a fraction of this force is acted on as a retractive force for the car $1_1$ through the jack $2_3$, anchor member $5_2$, linking member 3 and finally anchor member $5_1$.

Therefore, in a manner similar to that shown in the preceding step, the car $1_2$ while accepting as a reaction force the sum of the reaction forces of the cars $1_1$ and $1_3$ is caused to advance by a length (*l*) of one stroke. As shown in FIG. 8d, also in this case, a split is formed between the adjacent cars $1_2$ and $1_3$ as in the preceding step, and therefore there is provided a protection sleeve $10_2$ mounted at the rear end of the car $1_2$ and special interconnection rails $12_2$ mounted on the protection sleeve $10_2$. The protection sleeve $10_2$ and the interconnection rails $12_2$ are moved forwardly relative to the car $1_3$ as the car $1_2$ is moved forwardly.

In the last step, while the jack $2_2$ remains released, the jack $2_3$ so operated so that the reaction force relative to the propulsive force of the piston of the jack $2_3$ is transferred through the anchor member $5_2$, linking member 3 and anchor member $5_1$ to the car $1_1$ and is acted thereon as a retractive force, a fraction of which is further transferred through the jack $2_1$ to the intermediate car $1_2$. Therefore, as shown in FIG. 8e, by the linking member 3 it is effected to sum up the reeaction forces of the other cars $1_1$ and $1_2$, and the summed reaction forces serve to advance the tailing car $1_3$ forwardly by a length (*l*) of one stroke. At the same time, the special interconnection rails 8 which are connected to the leading edges thereof to the tailing edges of the rails $6_3$ on the platform of the car $1_3$ by means of hinged structure are moved forwardly while permitting the tailing edges of the said interconnection rails 8 to advance forwardly in sliding relation on the upper surfaces of the laid rails 7. Furthermore, the rails 9 which are newly being laid are left behind without forward movement, because of the previous connection to the laid rails 7, despite of the fact that the car $1_3$ is moved forwardly. As the car $1_3$ is moved, therfore, the rails 9 while being extracted from the chamber of the car $1_3$ are automatically laid down inasmuch as sleepers are inserted beneath the rails 9.

Figure 8A:
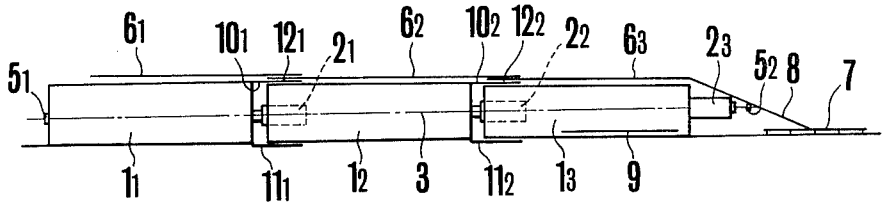
FIGS. 8*a* to 8*e* are side views of a modified embodiment of the above mentioned heavy load transporting method as for use in excavating a tunnel and showing an example of successively advanced steps of a process for advancing a number of working platforms adapted for extending rails for construction material transportation as the excavation proceeds and for laying rails.
Figure 8B:
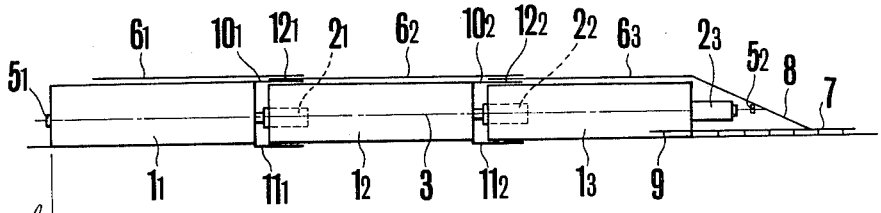
Figure 8C:
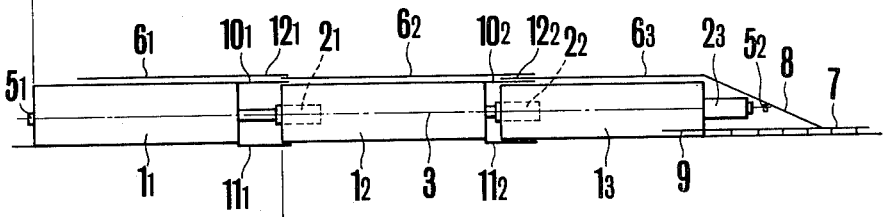
Figure 8D:
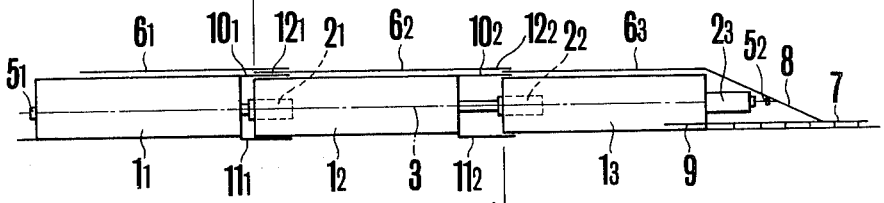
Figure 8E:
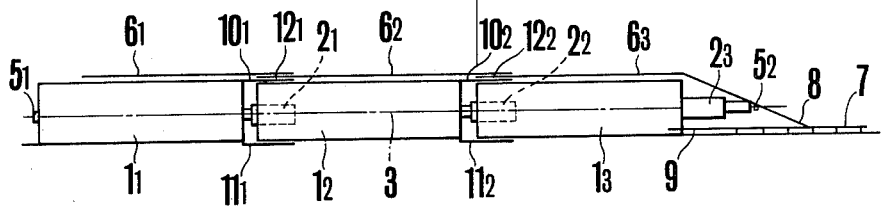

In the next place, upon release of the jack $2_3$, the train of apparatus are set to assume a position similar to that shown in FIG. 8*a* but resulted in one-stroke advancement therefrom. By repeating this procedure, it is possible to advance more than three cars $1_1$, $1_2$ and $1_3$ forwardly in sequence from front to rear in a continuously operated and self-running manner relative to the tunnel, while automatically laying new rails on the foundation of the tunnel.

In the following, the details of the apparatus for the advancement and railway construction will be explained in connection with the drawings mentioned below.

FIGS. 9A to 9F show an apparatus comprising three platform cars $1_1$, $1_2$ and $1_3$, two pairs of jacks $2_1$ and $2_2$ inserted between the adjacent two cars respectively, a pair of jacks $2_3$ of the hollow core or full core type arranged on the tailing platform car $1_3$ and which may be arranged on the forwardmost car $1_1$, two pair of linking members 3 arranged to pass through all the cars, eight anchor members $5_1$ and $5_2$ each connected to one of the eight ends of the four linking members 3, two reaction force receiving members 13 each arranged between the respective single jacks $2_3$ and respective single pair of linking members 3 for transmitting a load force between the jacks $2_3$ and anchor members $5_2$, operation rails $6_1$, $6_2$ and $6_3$ fixedly mounted on the upper surface of the plaform cars respectively, and two protection sleeves $10_1$ and $10_2$ connected to the rear ends of the cars $1_1$ and $1_2$ respectively by hinge structure and rearwardly extending to overlap on the next cars $1_2$ and $1_3$ respectively for the purpose of covering the splits which are to be formed between the adjacent two cars when the cars are advanced step by step in sequence relative to the next one as has been already mentioned before. There are further provided special interconnection rails $12_1$ and $12_2$ mounted on the outer surfaces of the respective protection sleeves $10_1$ and $10_2$ and arranged to interconnect the operation rails $6_1$, $6_2$ and $6_3$. If a single jack is used in combination with a single linking member, however, the linking member is inserted through the hollow at the core of jack.

The details of the above mentioned interconnecting sections are shown in enlarged scale in FIGS. 10A to 10D and FIG. 11a to FIG. 11C.

Figures 10A, 10B:
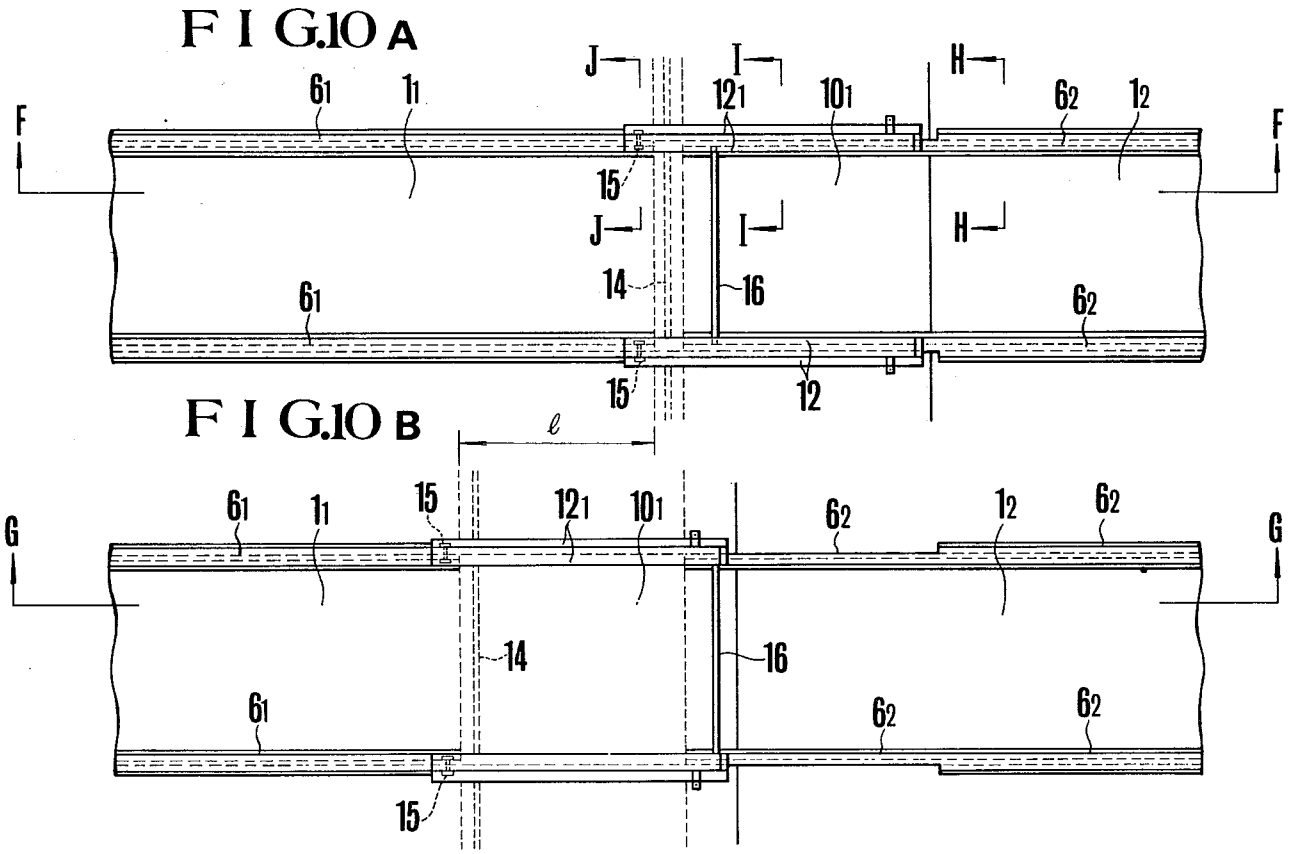
FIGS. 10A and 10B are top views of this region of the cars.
Figure 10C:
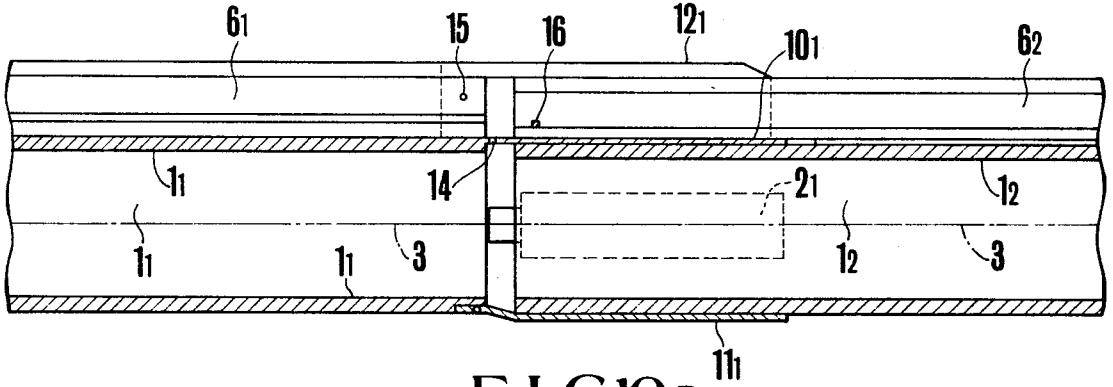
FIG. 10C is a longitudinal section taken along the line F—F of FIG. 10A
Figure 10D:
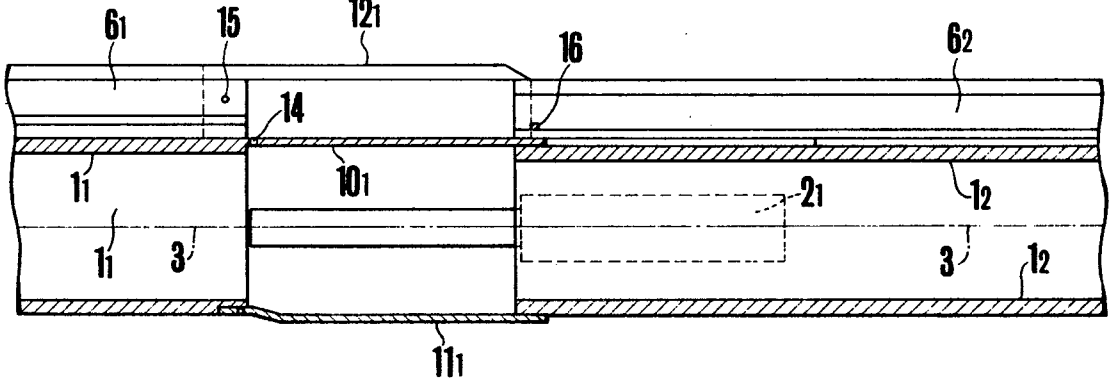
FIG. 10D is a longitudinal section taken along the line G—G of FIG. 10B, the above mentioned FIGS. 10A and 10C being shown in an operative position before the jack is operated, and FIGS. 10B and 10D in an operative position after the jack is operated.
Figure 11A:
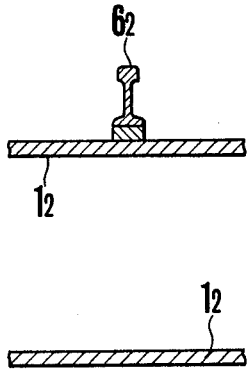
FIGS. 11A to 11C are transverse sections taken along the lines H—H, I—I and J—J of FIG. 10A respectively and showing a relationship between the rail fixedly laid on the car and the particular interconnection rail.
Figure 11B:
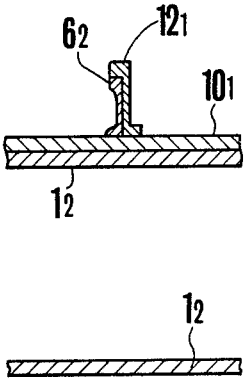
Figure 11C:
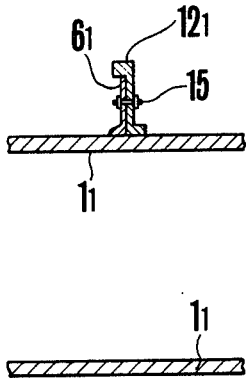

FIG. 10A is a fragmental top view of an operation railway at a region near the interconnection between the rails $6_1$ and $6_2$, in an operative position where no split is formed between the adjacent two cars $1_1$ and $1_2$. FIG. 10B is a fragmental top view of the operation railway at the same region as that of FIG. 10A in an operative position where a fuel split is formed after the jack $2_1$ has been operated. FIG. 10C is a cross-sectional view taken along F—F line of FIG. 10A, and FIG. 10D is a similar view taken along G—G line of FIG. 10B. FIG. 11A, FIG. 11B and FIG. 11C are cross-sectional views taken along lines H—H, I—I and J—J of FIG. 10A respectively.

The protection sleeve $10_2$ is connected to the rear end of the front adjacent car $1_1$ by means of hinge structure 14 and is provided with the special interconnection rails $12_1$ fixedly mounted on the outer surface thereof. This rail $12_1$ is, as shown in FIG. 11C, connected to the rear end of the operation rails $6_1$ by means of hinge structure 15. The width of the protection sleeve $10_1$ is almost equal to that of the car $1_1$, and the sleeve $10_1$ is arranged to be movable in sliding relation on the car $1_2$, as shown in FIG. 10D when the car $1_1$ is moved forwardly relative to the car $1_2$. The special interconnection rails $12_1$ are also simultaneously moved while sliding on the operation rail $6_2$ as shown in FIG. 11B.

As mentioned above, even when the car is being moved, the operation rails are always set by this special interconnection rails to permit the passage of transportation cars thereon without hindrance. In the Figures, the reference numeral 16 denotes separation securing members for the operation rails $6_2$.

Figure 9D:
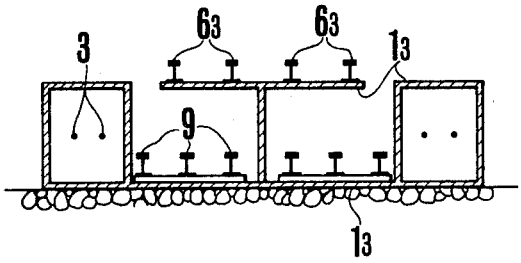
Figure 9E:
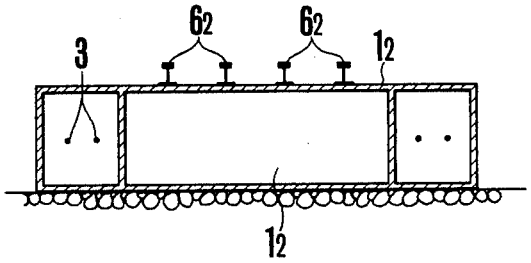
Figure 9F:
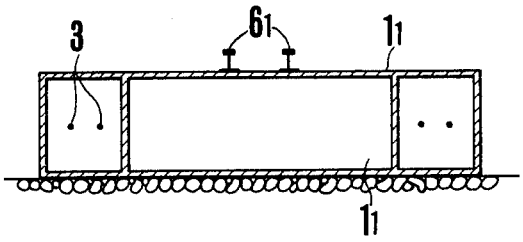
Figures 9A, 9B, 9C:
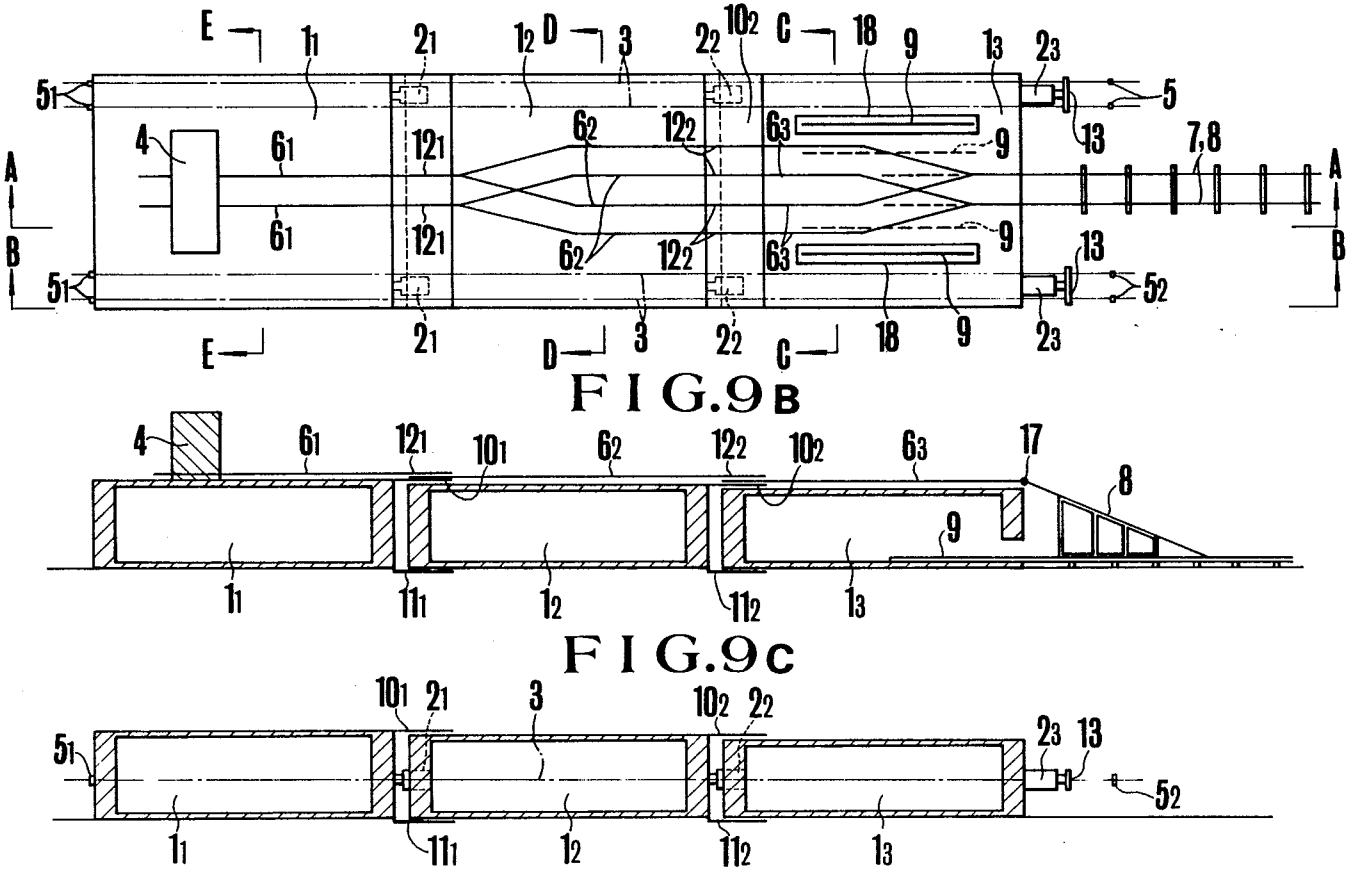

Further, the operation rails $6_3$ on the platform car $1_3$ are, as shown in FIG. 9B, connected to the special interconnection rails 8 by means of hinge structure 17, and the rails 8 are arranged so that their ends are slidingly moved on the previously laid rail 7 as the car $1_3$ is advanced forwardly.

As for the rail laying out apparatus, as shown in FIG. 9A, the new rails which are transported onto the platform car $1_3$ are put down through longitudinally elongated slots 18 into the storage chamber thereof and stored therein until they are laid down to construct an extended railway as mentioned above. It is preferred to provide rollers for facilitating the extraction of some of the stored new rails from the tailing platform car $1_3$ as the railway construction proceeds.

EXAMPLE IV

Figure 12:
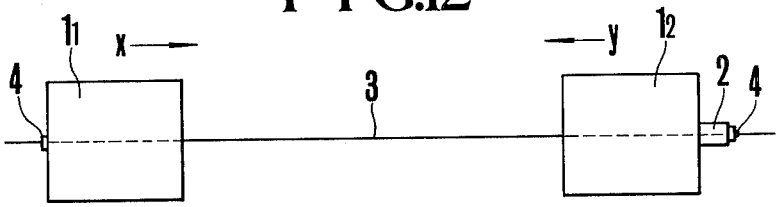
FIG. 12 is an elevational view of an arrangement of mutually opposed constructional units along a common advancing direction employing an advancing method of the prior art.

This examle is an example of the embodiment of the method of advancing a constructional unit group for underground structure construction according to the present invention as applied to an underground excavation such as a gallery in which said constructional unit group and another constructional unit spaced apart from each other in opposedly aligned relation are advanced toward each other FIG. 12 schematically shows a prior art apparatus comprising two tubular bodies $1_1$ and $1_2$. When a traction jack 2 is operated, the tubular body $1_1$ is advanced in a direction indicated by arrow (*x*) by utilizing the reaction force of the other tubular body $1_2$ through the traction member 3 and fixing members 4. The tubular body $1_2$ also is advanced in a direction of arrow (*y*) in a manner similar to the above. This prior art method gives rise to the above mentioned drawbacks.

Figure 13A:
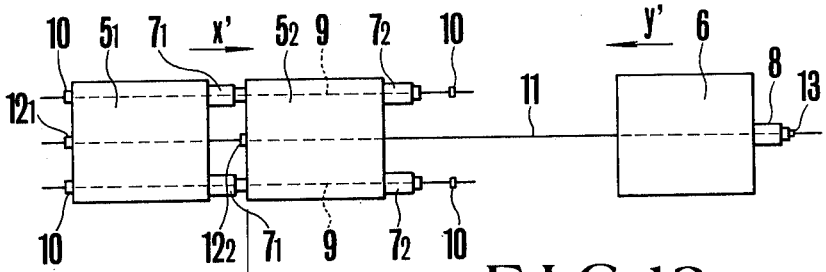
FIGS. 13A to 13C are top views of an example of the steps of an advancing process according to the invention as applied to a case wherein a group of constructional units paired with each other is advanced along with an additional constructional unit toward each other.
Figure 13B:
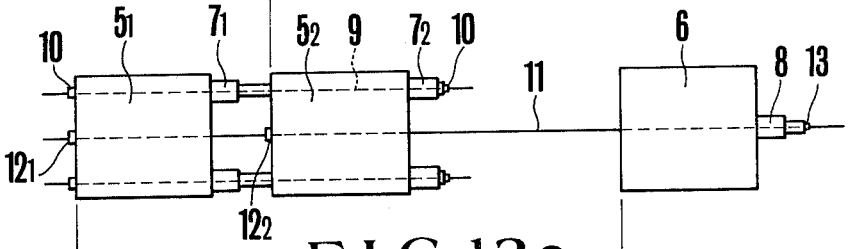
Figure 13C:
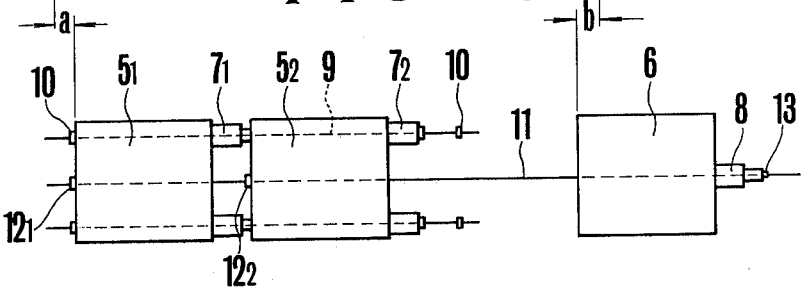

FIGS. 13A, 13B and 13C show an example of the method of advancing opposedly disposed undergound structure unit groups (tubular form) toward each other, and are top views corresponding to the respective steps of a process for advancing the opposedly disposed tubular body units or rings as approaching to each other in their respective opposite directions (*x'*) and (*y'*).

In FIG. 12A, on one side, there is shown a ring group composed, in the simplest instance of two rings $5_1$and $5_2$, and on the other side there is shown a ring 6 opposed thereto and arranged in alignment with the rings $5_1$and $5_2$. The rings $5_1$ and $5_2$are provided with respective propulsion jacks 7hd 1and $7_2$ mounted thereon. There are further provided linking members 9 arranged to pass through the rings $5_1$ and $5_2$ and having fixers 10 mounted at the respective ends thereof, so that the rings $5_1$and $5_2$, the propulsion jacks $7_1$ and $7_2$, the linking members 9 and fixers 10 are organically connected to one another. The opposed ring 6 is provided with a traction jack 8. A traction member 11 passes through the rings group $5_1$, $5_2$ and the ring 6 and is provided with fixers $12_1$ and $12_2$ detachably mounted thereon and through which the rings $5_1$and $5_2$are respectively engaged with the linking member 11, while the ring 6 is connected to the traction member 11 through the traction jack 8 and the fixer 13.

In operating the above-described apparatus, with reference to FIG. 13B, the propulsion jack $7_1$ is operated while the fixer $12_1$ is set to the released position but the fixer $12_2$is set to the active position. B operating the traction jack 8 in addition to the operation of the jack $7_1$, the ring $5_2$ is advanced relative to the ring $5_1$ through the length (*a*) of one stroke, with the sum of the reaction forces of the rings $5_1$and 6 being utilized as the action force for the advancement of the ring $5_2$. Next, the propulsion jack $7_1$is released to the retracted position, and then the other propulsion jack $7_2$ is operated, while the fixer $12_2$ is released, but the other fixer $12_1$ is fixed. By operating the traction jack 8 in addition to the operation of the jack $7_2$, the ring $5_1$ is advanced toward the ring $5_2$by the length (*a*) of one stroke with utilization of the summed reaction forces of the rings $5_2$ and 6.

By repeating the above-described procedure, the ring group is advanced relative to the ground in a self-running manner.

In FIG. 13C, the opposedly disposed ring 6 while the fixers $12_1$ and $12_2$ being in the active positions is advanced by operating the traction jack 8 through a length (*b*) of one stroke with utilization of the summed reaction forces of the rings $5_1$is advanced to a desired location.

In this example, the method of, and apparatus for excavating the ground, conveying the soil to disposal as the underground tubular structure advances forwardly, and further the means for protecting or shielding the splits formed between the adjacent tubular elements are equivalent to those shown in connection with the other examples of the embodiments of the invention, and therefore their illustration and explanation are ommitted.

Figure 14A:
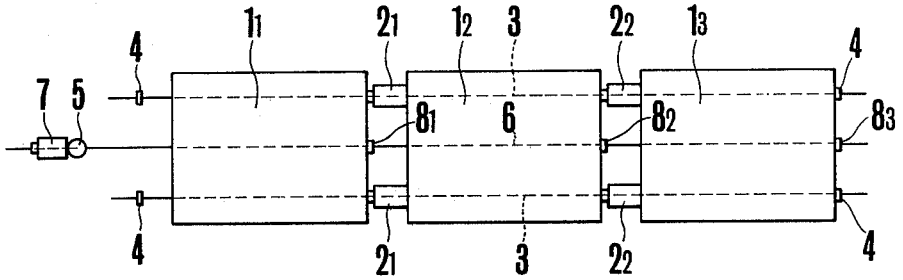
FIG. 14A is a top view showing an example of variation of the above mentioned method for advancing opposedly arranged constructional units toward each other wherein the constructional unit opposite to the constructional unit group is removed and instead the anchoring member is arranged in a fixed relation to the ground.

FIG. 14A is a modification of the apparatus shown in the above-described example.

In FIG. 14A, there are shown three tublar elements $1_1$, $1_2$and $1_3$, propulsion jacks $2_1$ and $2_2$ arranged between the successive elements, and linking member 3 passing through all the tubular elements and havng fixers 4 mounted at the respective ends thereof so that these parts are organically interrelated with one another. Instead of the opposedly arranged ring shown in FIGS. 13A to 13C, there is provided a suitable anchor structure 5 as arranged in front of the train of the tubular elements $1_1$, $1_2$and $1_3$. Psssing through this anchor structure 5 and the tubular element group, there is shown a traction member 6 associated with a traction jack 7 at a location outside the anchor structure 5 and having fixers $8_1$, $8_2$and $8_3$detachably mounted thereon. In this arrangement, all the tubular elements, anchor structure, traction member 6, traction jack 7 and fixers $8_1$, $8_2$ and $8_3$are organically interrelated to establish the installation of an apparatus with the train of the tubular elements.

In operating the above-described apparatus, with reference to FIG. 14A, it is at first to set the fixer $8_1$in the active position and the other fixers $8_2$and $8_3$in the idle position. Next the propulsion jack $2_1$is operated to push the tubular element $1_1$by utilizing the summed reaction forces of the tubular elements $1_2$ and $1_3$, and at the same time the traction jack 7 is operated to attract the tubular element $1_1$with the reaction force of the anchor structure 5 being as the reaction force, thereby the tubular element $1_1$is advance forwardly through a length (*l*) of one stroke under the cooperating action of the both jacks $2_1$ and 7.

The subsequent steps operate in a manner similar to that shown in the above-described example and therefore explained in brief without particular illustration of drawings therefor. After the propulsion jack $2_1$and fixer $8_1$both are released, the fixer $8_2$is set to the active position and then the traction jack 7 is set to the renewed or starting position, then the propulsion jack $2_2$is operated to push the intermediate tubular element $1_2$by utilizing the summed reaction forces of the foremost and tailing tubular elements $1_1$and $1_3$ and simultaneously the traction jack 7 is operated to attract the intermediate tubular element $1_2$ by utilizing the reaction force of the anchor structure 5, thereby the intermediate tubular element $1_2$ is advanced relative to the tailing tubular element $1_3$and to the ground by the length (*l*) of one stroke under the cooperating action of the both jacks $2_2$and 7.

For the advancement of the tailing tublar elmeent which is somewhat larger in size than the other tubular elements, the fixer $8_3$is set to the active position, then traction jack 7 is operated, thereby the tailing tubular element $1_3$ is advanced by the length (*l*) of one stroke relative to the ground with the help of the reaction force of the anchor structure 5.

The above-described procedure repeats itself until the tubular element group arrives at a desired location.

Figure 14B:
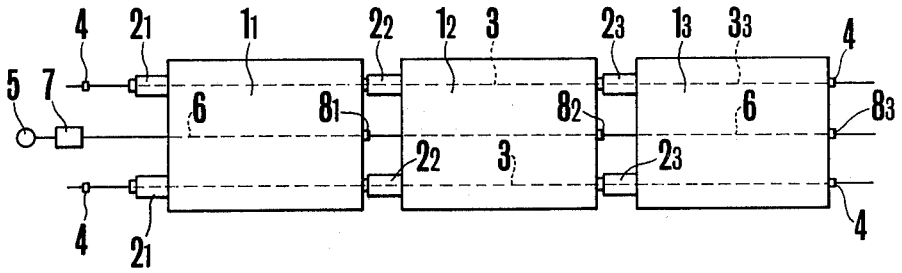
FIG. 14B is a top view showing another example in which the anchoring member and traction jack of FIG. 14A are replaced by each other.

FIG. 14B shows a modification of the embodiment of the invention in which there is provided a propulsion jack $2_1$on the fowardmost or tailing tublar element, and attraction jack 7 is arranged between an anchor structure 5 and a forwardmost tubular elemet $1_1$. In this point, the apparatus of FIG. 14B is different from that of FIG. 14A, but the manner in which the apparatus of FIG. 14B operates is similar to that for the apparatus of FIG. 14A, and the effectiveness also does not differ therefrom. Accordingly, the explanation concerning to the construction, arrangement and operation is omitted.

EXAMPLE V

This example is an example of the embodiment of the method of advancing an underground structure in self-running manner according to the invention as applied to a process for installing a tunnel structure under water as it advances in a self-running manner from the land into water while permitting the water to enter the interior of each of the constructional units.

FIGS. 15*a* to 15*e* are side views showing respective steps of the process for advancing the underwater constructional unit group infinitely in a self-running manner based on the above mentioned method of the invention, wherein the reference numeral 1 denotes a water surface, and 2 denotes a foundation of the propulsion station for the tunnel structure units located near the shore of water.

Figure 15A:
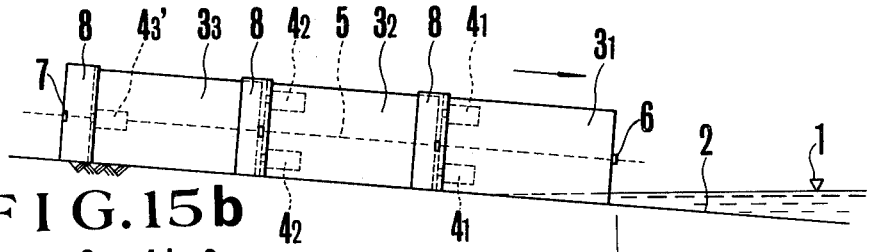
FIGS 15*a* to 15*e* are side views of an example of an apparatus for performing the underground structure self-propelled advancing method according to the invention as applied to the construction of an underwater tunnel wherein a group of constructional units for the tunnel is advanced in a self-running manner while permitting entrance of water into the interior thereof, and respectively showing successive steps of an advancement process.

In FIG. 15*a*,there are shown three constructional units $3_1$, $3_2$ and $3_3$ arranged in a longitudinal alignment with each other on the station 2, propulsion jacks $4_1$ and $4_2$ respectively positioned between the successive units, a linking member 5 extending over the entire length of the constructional unit group in a path outside or inside thereof, front and rear fixers 6 and 7 located at the respective ends of the linking member 5, a propulsion or traction jack type impelling facility 5′ associated with the linking member 5, these parts being arranged so that the constructional units $3_1$, $3_2$ and $3_3$, the propulsion jacks $4_1$ and $4_2$, the linking member 5, the traction of or propulsion impelling jack facility 5′ and the fixers 6 and 7 are organically interrelated with one another. There are further provided water-proof shielding ring-like devices 8 each connected to the rear end of one of the constructional units.

Figure 15B:
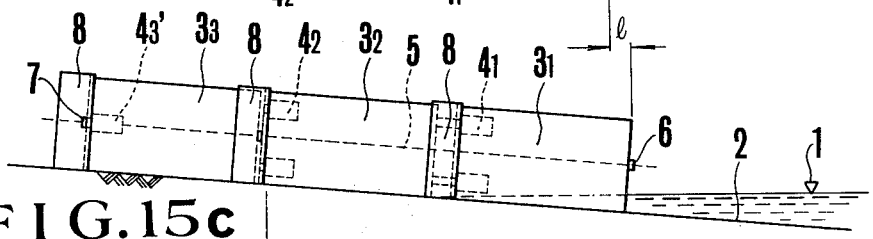

In operating the above-described apparatus, as shown in FIG. 15*b*, it is at first to operate the propulsion jack $4_1$ between the constructional units $3_1$ and $3_2$ to advance the forwardmost unit $3_1$ through a length (*l*) of one stroke relative to the intermediate unit $3_2$ and to the foundation 2 with the help of the summed reaction forces of the constructional units $3_2$ and $3_3$.

Figure 15C:
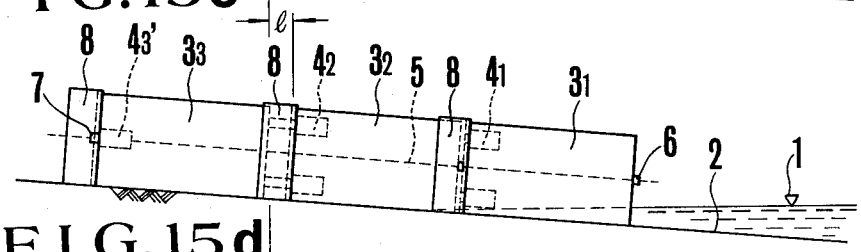

As shown in FIG. 15*c*, the propulsion jack $4_1$ is released to the retracted position, then the propulsion jack $4_2$ between the constructional units $3_2$ and $3_3$ is operated to advance the intermediate unit $3_2$ by the length (*l*) of one stroke with the help of the reaction forces of the forwardmost and tailing units which are summed up by the interconnecting mechanism comprising the linking member 5 and the fixers 6 and 7.

Figure 15D:
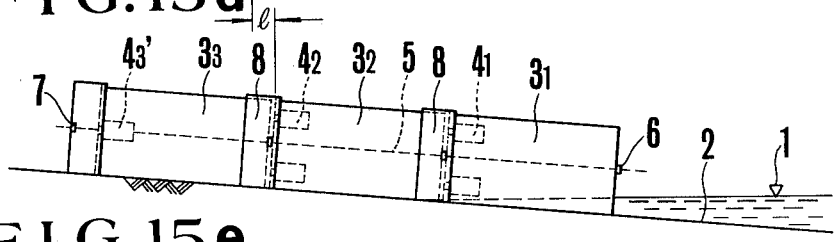
Figure 15E:
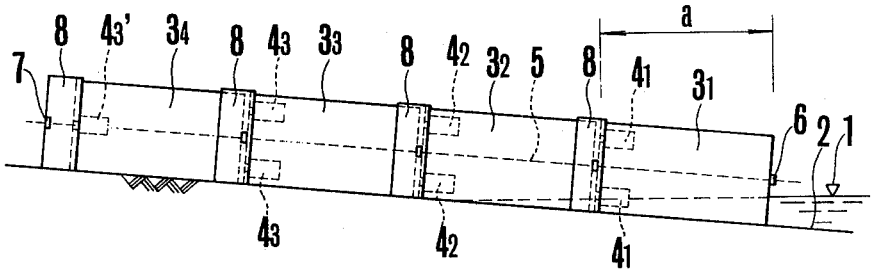

Next, as in FIG. 15*d*, the above mentioned jack impelling facility 5′ mounted on the rear end of the linking member 5 is put into operation, thereby the tailing constructional unit $3_3$ is advanced by the length (*l*) of one stroke with the help of the summed reaction forces of the units $3_1$ and $3_2$ through the linking member 5.

When the constructional unit group has advanced through a distance equal to the length (*a*) of one constructional unit by repeating the above-described procedure in a necessary number of times, an additional constructional unit $3_4$ is brought into engagement with the tailing constructional unit $3_3$ in end-to-end relation. This fourth unit $3_4$ is provided with a propulsion jack $4_3$ and a water-proof shielding ring-like device 8. The linking member 5 is extended to pass through the fourth constructional unit $3_4$, and the rear fixer 7 is displaced to a location for cooperation with the fourth unit $3_4$. As a result, an extended structure is formed comprising four constructional units $3_1$ to $3_4$. Such procedure repeats itself to advance the constructional unit group continuously until an underwater tunnel structure of a predetermined length is installed.

Figure 16:
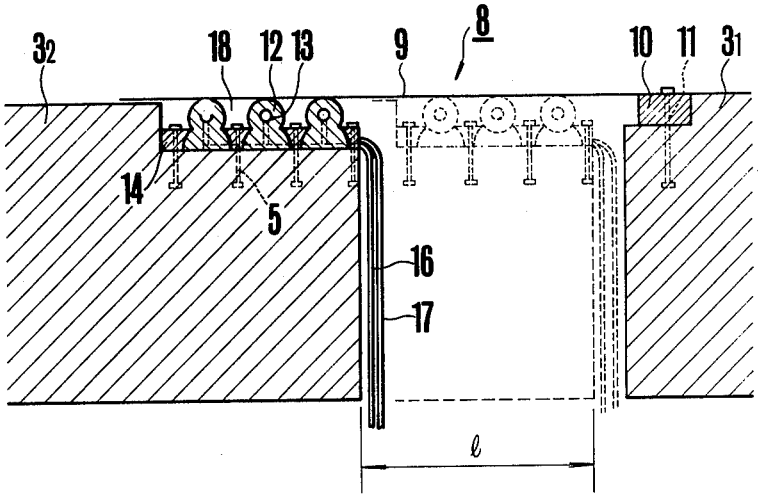
FIG. 16 is a longitudinal sectional view of a water-proof sleeve device.

FIG. 16 is a cross-sectional view showing a part of the joint section between the adjacent constructional units, wherein the portions illustrated by the dashed lines show respectively a state where the rear constructional unit $3_2$ has advanced through the length (*l*) of one stroke, and a joining portion of the entire constructional unit at a time when the advancement of the constructional unit group has ultimately finished. The water-proof shielding ring device 8 positioned at the said joint section has a cover plate 9 connected at its front edge through a water-proof member 10 to the constructional unit $3_1$ by a fastener 11, the opposite or rear edge of which is arranged so as to slidingly overlap on the constructional unit $3_2$. Between the cover plate 9 and the constructional unit $3_2$ is one or more elastic waterproof members 12 having holes 13 and connected to the constructional unit $3_2$by a supporter 14 and fastener 15. The hole 13 is communicated with an injection tube 16, and another grout pipe 17 is arranged with its front end being exposed to a space 18 between the respective water-proof plates 12 in the cover plate 9. The cover plate 9 and the water-proof plates 10 and 12 are so dimensioned as to overlap the entire periphery of each constructional unit.

The above mentioned water-proof shielding ring device functions to prevent the entrance of soil to the split of the joint section by the cover plate 9 and the water-proof members 10 and 12. After the installation of the tunnel structure, a compressed fluid is supplied through the injection tube 16 to the hole 13, thereby the hole 13 is expanded to contact with the cover plate 9 to retain the water-tightness, and, through the grout pipe 17, a cementations material is poured into the space between the elastic water-proof members to establish the complete water-proof state. After that, the water in the interior of the constructional unit group is completely removed to make hollow the tunnel structure under the water.

Figure 17A:
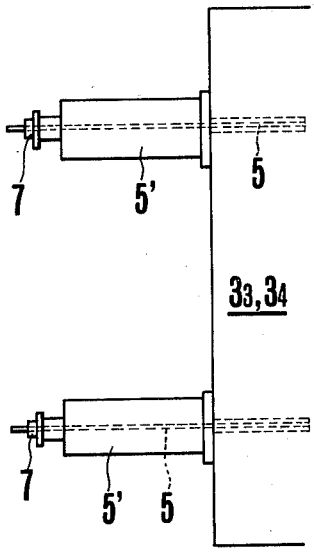
FIGS. 17*a* and 17*b* are top views respectively showing jack-advancing means by traction or propellant mounted on each constructional unit.
Figure 17B:
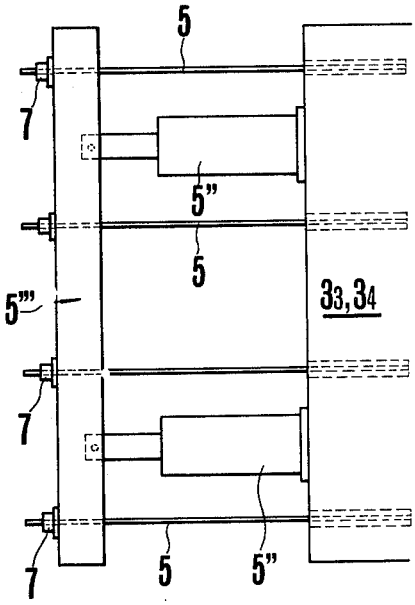

FIGS. 17*a* and 17*b* are top views respectively showing traction or propulsion jack impelling facilities 5′ and 5″ mounted on the respective ends of the linking members 5. The reference character 5′ denotes a hollow core type jack, and 5″ denotes an usual full core type propulsion jack, and 5‴ denotes a reaction force receiver. The other reference characters denotes the similar parts to those shown above.

The above mentioned process for advancing the constructional unit group in a self-running manner by the remote control from the land while permitting the entrance of water into the interior of the unit group to install a tunnel structure under water may be otherwise performed by use of the apparatus with a modification depending upon the situation of the working place. An example of modification is shown below.

Figure 18:
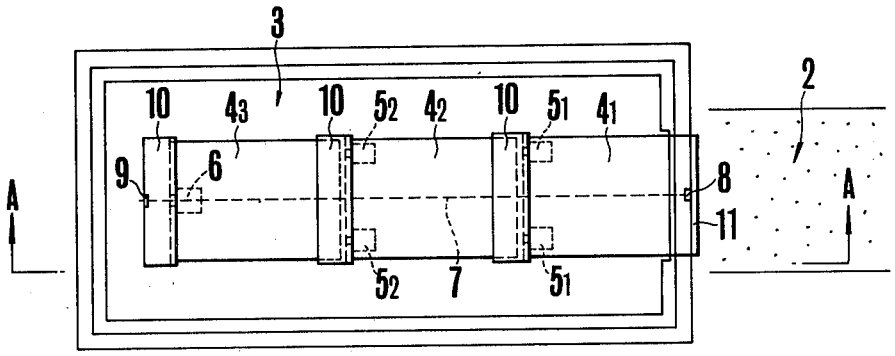
FIG. 18 is a top view of a group of constructional units arranged on an underwater departure station in an example of the method for advancing the constructional unit group in a self-running manner under the water while permitting no storage of water in or a somewhat entrance of water to the interior thereof.
Figure 19A:
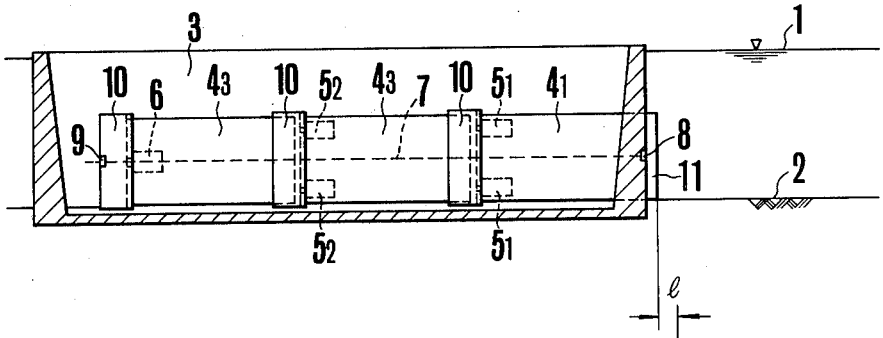
FIGS. 19*a* and 19*b* are longitudinal sectional views taken along the A—A line of FIG. 18 and showing the first and last steps of a process for advancing the constructional unit group. The second advancing step and the steps to follow are not illustrated because of the equivalence to those of FIGS. 15*c* to 15*e*.
Figure 19B:
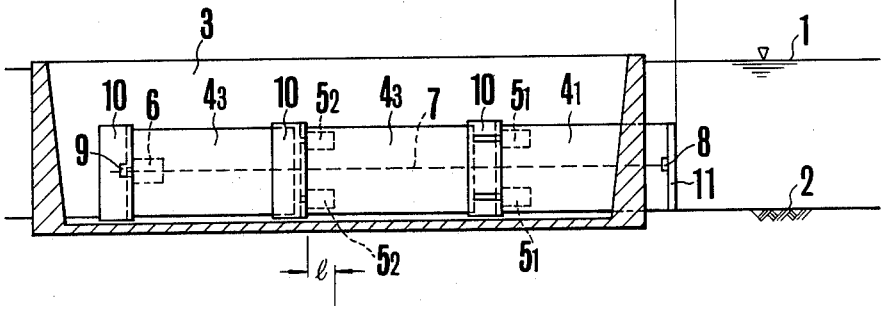

This example of modification is adapted for use with an underwater propulsion station, and is shown in FIG. 18 for its top view and in FIG. 19*a* and 19*b* for its longitudinal sectional views. FIG. 19*a* is taken along A—A line of FIG. 18, and FIGS. 19*a* and 19*b* show the first and last steps respectively of one unit length advancement in a process for advancing the constructional unit group for construction of an underwater tunnel structure in a self-running manner. The intermediate steps, for example, second and third steps of this one length advancement are similar in operation to the first and last steps, and, therefore the drawings showing these steps are omitted to conserve space.

IN FIGS. 18, 19*a* and 19*b*, the reference character 1 is a water surface, 2 is a previously laid foundation on which an underwater tunnel structure is to be installed, 3 is a previously constructed propulsion station on which a number of constructional units 4 are put into a longitudinal arrangement, $5_1$ and $5_2$ are propulsion jacks positioned between the adjacent constructional units, 6 is a traction or propulsion jack type impelling facility, 7 is a linking member arranged outside or inside the constructional unit arrangement to extend therethrough, 8 is a fixer mounted at the front end of the linking member 7, 9 is a fixer detachably mounted through the jack impelling facility 6 at the rear end of the linking member 7, 10 is a water-proof shielding ring device provided at the joint section of each constructional unit, and 11 is a water-proof device tightly mounted on the front face of the forwardmost constructional unit $4_1$.

The operation of the above-described apparatus for advancing the individual constructional units in a self-running manner are comprised of the steps similar to those shown in connection with the above-described example, and, therefore, its explanation is omitted.

However, because of the absence of water in the interior of individual constructional units, as the units advance to protrude from the station into water, the buoyant force applied thereto is gradually increased. In order to adjust the balance between the buoyant force and the weight of the individual constructional units, the ballast adjustment is employed, the ballast may be in part water pumped or entered into the interior of the unit or a heavy load loaded therein according to the need. In such a way, after the constructional unit group has advanced by a length (a) of one constructional unit, an additional new constructional unit having a propulsion jack and a water-proof shielding ring device is put into arrangement in the rear of the constructional unit $4_3$. The linking member 7 is extended to pass through the additional unit, and the fixer 9 is displaced to a location behind the new unit. Such a procedure repeats itself until the entire underwater tunnel construction is established at the desired location.

Figure 20A:
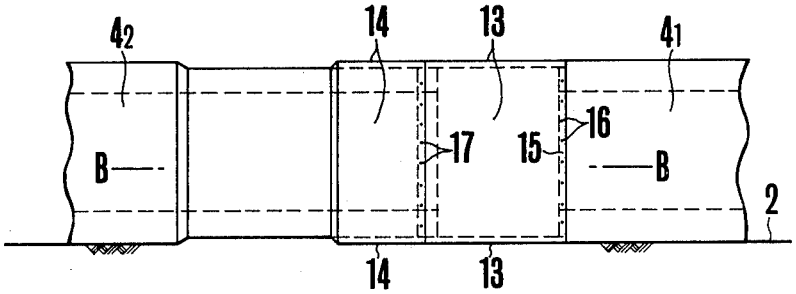
FIG. 20*a* is a side view showing an integral structure of the water-proof sleeve at a region near the engagement of the adjacent constructional units.
Figure 20B:
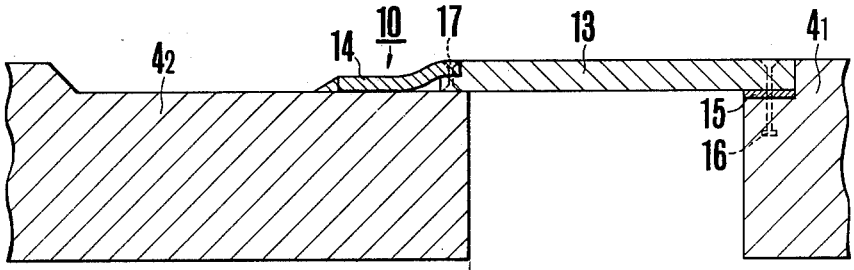
FIGS. 20*b* and 20*c* are fragmental sectional views taken along the B—B line of FIG. 20*a*.
Figure 20C:
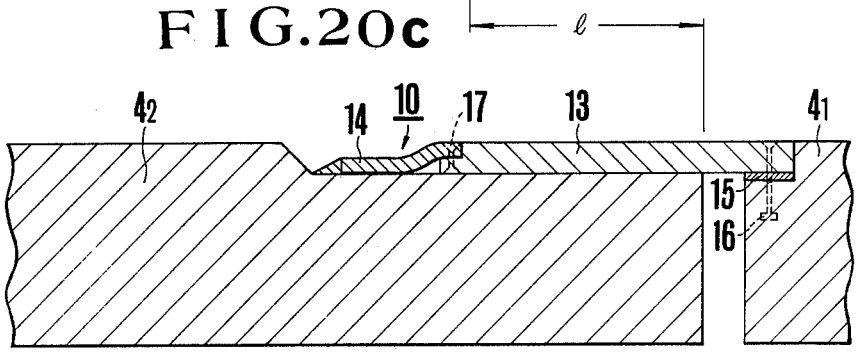

FIG. 20*a* is a side view showing the detail of the water-proof shielding ring device located between the adjacent constructional units. FIGS. 20*b* and 20*c* are longitudinal sectional views of a part of the device taken along B—B line of FIG. 20*a* in the respective operative positions wherein FIG. 20*b* shows the maximum split which is formed when the forwardmost unit $4_1$ has advanced by a length (*l*) of one stroke relative to the next unit $4_2$, and FIG. 20*c* shows the minimum split which is formed when the second unit $4_2$ has advanced by the length (*l*) of one stroke toward the forwardmost unit $4_1$.

The water-proof shielding ring device 10 is shown as comprising a rigid ring sheet 13, a water-proof flexible ring cover band 14 water-tightly adhered to the rigid ring sheet 13 by a cement or fastener 17 and water-tightly overlapping around the outer periphery of the constructional unit $4_2$. The rigid ring sheet 13 is connected at its front end to the rear end of the constructional unit $4_1$ through a water-proof member 15 by a fastener 16. As the split formed between the units $4_1$ and $4_2$ is decreased in length from the maximum shown in FIG. 20*b* to the minimum shown 20*c*, the front end portion of the second unit $4_2$ is slidingly moved in the water-proof shielding ring sheet 13 in intimately fitting relation thereto.

With the apparatus of such construction and arrangement, as the constructional units individually advance forwardly, the water-proof shielding ring sheet and water-proof cover band are moved in sliding relation on the outer periphery of the following constructional unit, while the said water-proof shielding ring sheet resisting against the water pressure and preventing the entrance of soil and water into the tunnel through the split formed between the adjacent constructional units, and while the water-proof flexible ring cover band being set by the water pressure from the outside to automatically retain the watertightness against the outer periphery of the following constructional unit, thereby it being made possible to insure that the interior of the constructional unit group is maintained in the empty state to facilitate the performance of various workings for the tunnelling with safety and accurately, and further the environmental static water pressure can be automatically utilized to enable the water-proof device to prevent seepage flow of water into the tunnel.

EXAMPLE VI:

This example is an example of application of the method of installing an underwater tunnel structure shown in the above mentioned Example V to the process for constructing an underground structure in a water-pressure-acting ground by combination with a compressed air engineering which requires the installation of a compressed air chamber, an air pressure buffering chamber and a compressed air generating equipment within the interior of the forwardly arranged constructional unit or units to prevent seepage flow from the front face of the tunnel into the tunnel, or to prevent cave-in of the front face of the tunnel.

Figure 21A:
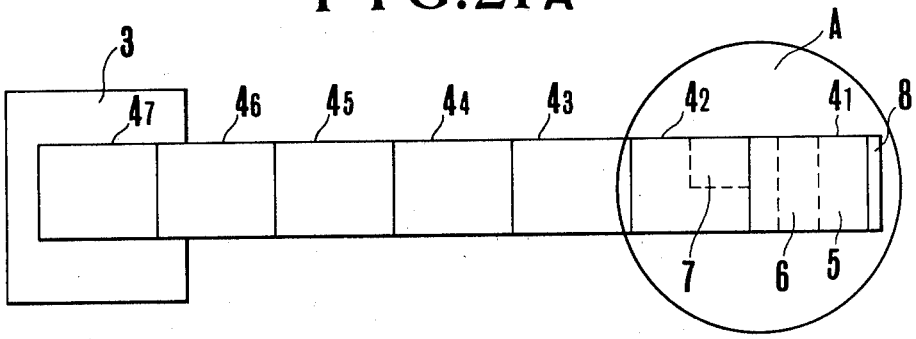
FIGS. 21A and 21B are top and side views respectively of an arrangement of a constructional unit group as an example of application of the underground structure self-run advancing method of the invention to the construction of a tunnel under the action of water pressure by the compressed air engineering in combination therewith.
Figure 21B:
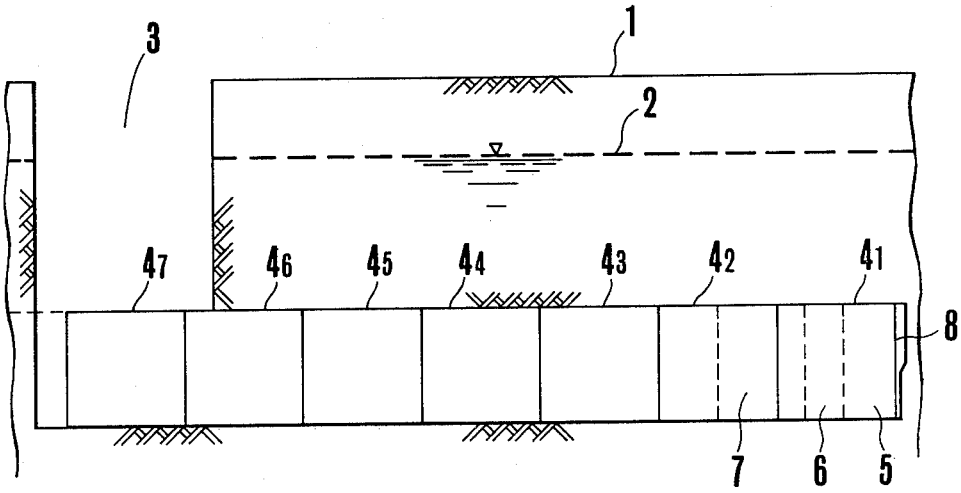

FIGS. 21A and 21B are top and side views showing an intermediate step of a process for advancing a constructional unit group in a self-running manner to an installation site while enabling the unit group to excavate a tunnel from a shaft serving as a protrusion station.

In FIG. 21, the reference character 1 denotes the ground surface, 2 denotes the level of underground water body, and 3 denotes a protrusion station.

The method of advancing an underground structure element group in a self-running manner has already been explained in detail in connection with the above mentioned various examples, and therefore the process for performing the method in this example will be briefly outlined below.

A number of constructional units $4_1$ are provided with propulsion jacks as arranged between the successive units and with a linking member having a fixer mounted at one end thereof and having an impelling jack mounted at the opposite end and arranged to interconnect all the constructional units. The constructional units are individually advanced in sequence from front to rear each at a time by successively operating the propulsion jacks and impelling jack in order from the front to the next. When all the constructional units $4_1$ through $4_n$ have advanced by a distance equal to the length of one unit relative to the ground, an additional new constructional unit numbered $4_n + 1$ is added to the laid units. Thus, an underground tunnel structure of a desired length can be installed at a desired site. It is to be noted that the forwardmost constructional unit is provided with cutter 8, and each of the joint sections between the adjacent two units is provided with a waterproof shielding ring sheet 12 as shown in FIG. 22.

In order to prevent the gushing-out of underground water from the excavating face as the level 2 of the underground water body is higher than the site of the tunnel, there is provided a compressed air chamber 5 which is filled with a compressed air of a high pressure compatible with the water pressure and which also serves for excavation and picking up the spoil, said chamber 5 being located at a front portion of the interior of the forwardmost constructional unit 4. In its rear and adjacent thereto, there is located an air pressure buffering chamber 6 for buffering the interior pressure against the outside pressure when the spoil is conveyed from the excavating section in the chamber 5 to disposal and when the operator enters or exits the compressed air chamber. Further adjacent to the pressure buffering chamber 6 is the compressd air producing equipment chamber 7 in which a set of high pressure air generating machines are installed and from which an air flow of high pressure is sent to the chamber 5 directly, so that the excavating and the spoil conveying operation can be performed under optimum air pressure condition. The pressure buffering chamber 7 is also supplied with a compressd air flow from the chamber 7 to facilitate the communication between the compressed air chamber 5 and the outside, and to maintain the pressure of the compressed air chamber 5 at almost a constant level. Accordingly, in the ground with a water pressure, the rapid seepage of water flow into the tunnel under the action of this water pressure can be prevented by the pressure of the compressed air when the excavation is carried out while advancing the constructional units $4_1$, $4_2, \ldots, 4_n$ in sequence step by step with the chambers 5, 6 and 7, which are provided in the first and second constructional units counting from the front being automatically advanced forwardly as the units $4_1$ and $4_2$ advances forwardly.

Figure 22A:
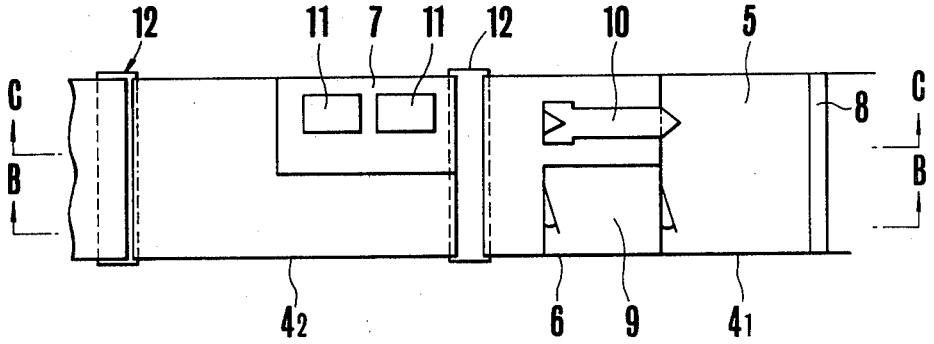
FIG. 22A is a top view showing the details of the structure of the circled section A of FIG. 21A in an enlarged scale.
Figure 22B:
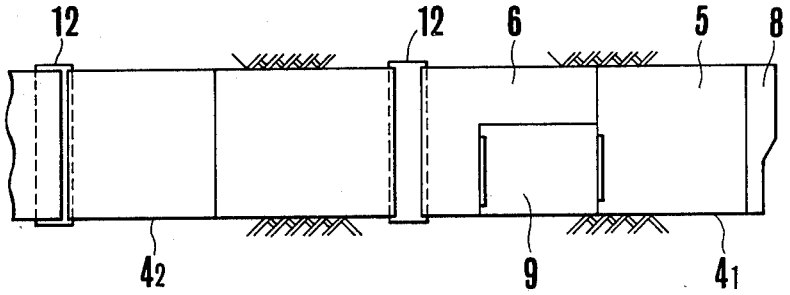
FIGS. 22B and 22C are longitudinal sections taken along the B—B line and the C—C line of FIG. 22A respectively.
Figure 22C:
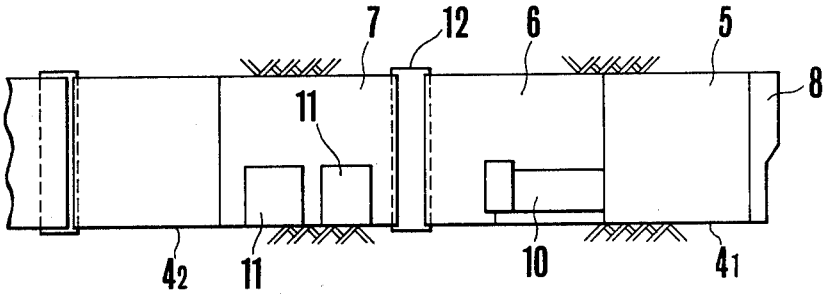

In this example, all the equipments concerning the compressed air production are concentrically arranged in the constructional unit $4_1$ or $4_2$, and this arrangement is shown in more detail in FIGS. 22A, 22B and 22C.

FIG. 22A is its top view, and FIGS. 22B and 22C are longitudinal sectional views taken along B—B line and C—C line of FIG. 22A respectively.

In FIG. 22, the reference character 5 is the compressed air-conditioned working chamber filled with a high-pressure air, 6 is the pressure buffering chamber having a function of making it possible to communicate into the compressed air chamber 6 with the outside and having mounted therein a pressure adjusting equipment 10 for permitting the passage of the operator therethrough and another pressure adjusting equipment 9 for permitting the transportation of the spoil and various facilities therethrough, 7 is the compressed air producing equipment chamber in which a set of compressed air generating machines 11 and control apparatus therefor is installed.

EXAMPLE VII

This example is an example of the embodiment of the method for advancing a constructional unit group in a self-running manner accordng to the invention as applied to a process for constructing an underground structure in a soft sandy ground by the muddy water excavation advancing method.

Figure 23A:
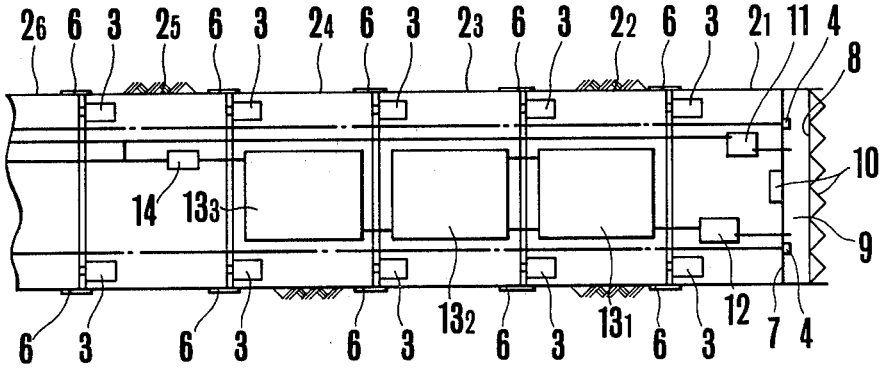
FIGS. 23A and 23B are top and side views respectively showing an example of an apparatus adapted for construction of an underground structure in a soft sandy earth and for use in an improved method resulting from the combination of the run method of an advancing self-run constructional unit group according to the invention with a muddy water jet excavation advancing method.
Figure 23B:
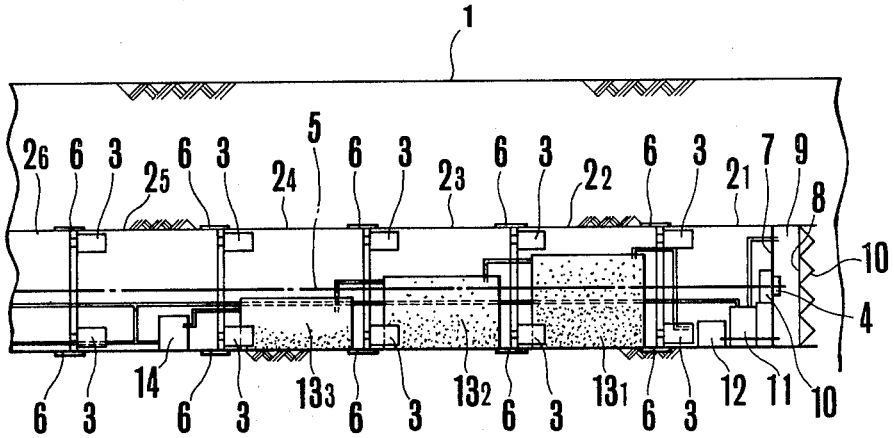

FIG. 23A is a top view showing an arrangement of various equipments in the interior of a number of constructional units constituting front part of the constructional unit group, and FIG. 23B is its side view.

The method of advancing a constructional unit group in a self-running manner according to the invention has already been described in detail in connection with Examples I, II and so forth. Accordingly, this example will be explained briefly about its essential points.

In FIGS. 23A and 23B, the reference numeral 1 denotes the surface of the ground. Between the successive constructional units of the group $2_1, 2_2 \ldots 2_n$ are respective propulsion jacks 3. Inserted as passing through all the constructional units is a linking member having a fixer 4 mounted at one end thereof and having an advancing jack facility not shown mounted at the opposite end thereof behind the tailing constructional unit so that all the constructional units are interconnected organically. Further, between the successive constructional units $2_1, 2_2 \ldots, 2_n$ are provided respective shielding rings 6. The resulting train of underground strucrture which is to be advanced in a self-running manner to a desired site of installation is shown in FIGS. 23A and 23B.

In order to perform advantageously the muddy water excavation advancement according to this example, there are provided a muddy water chamber 9 defined by a cutting face plane 8 and a water-tight pressure bulkhead 7 rigidly mounted in the forwardmost unit $2_1$ and dimensioned to cover the entire cross-sectional area thereof, and a set of muddy water excavating equipments arranged in the forwardmost unit $2_1$ adjacent the muddy water chamber 9 and including water jetting means 11 and muddy water pumping-out means 12. There is further provided a number of muddy water settling vessel means $13_1, 13_2 \ldots 13_{(k-l)}$, arranged in respective following constructional units $2_2, 2_3 \ldots 2_k$, because of the occupation of relatively large space by themselves, whereby a large proportion of water separated from the muddy water is recirculated to the water jetting means 11 by means of a pump 14, the remaining water being discarded to the outside of the constructional unit group. As the unit group advances forwardly in a self-running manner to infinite, therefore, the above mentioned various equipments also automatically advance forwardly.

EXAMPLE VIII

This example is an example of the embodiment of the method of advancing a constructional unit group in a self-running manner to infinite according to the present invention as applied to a process for constructing an unerground structure in a hard ground wherein a reaction force creating apparatus is employed to advantageously perform the excavation advancement of said constructional unit group.

In this example, the reaction force creating apparatus is shown as arranged in an intermediate one unit of the constructional unit group.

FIG. 24A is a top view showing an arrangement of three constructional units $2_1$, $2_2$ and $2_3$ installed in the ground, FIG. 24B is its horizontal sectional view, and FIG. 24 is its cross-sectional view.

The method of advancing a group of constructional units $2_1$, $2_2$ and $2_3$ in a self-running manner to infinite has already been described in detail in the above mentioned Example I and other Examples that follow. Accordingly, this example will be explained briefly as outlined with respect to the essential points.

The individual constructional units $2_1$, $2_2$ and $2_3$ are arranged in a longitudinal alignment with each other in the hard ground 1, between which respective propulsion jacks $3_1$ and $3_2$ are positioned, and which are organically interconnected by a linking member 5 having a fixer 4 mounted at the front end thereof and having an advancing jack device 6 mounted at the rear end thereof, as the linking member 5 is inserted through the all the constructional units. By operating the propulsion jacks $3_1$ and $3_2$ and the advancing jack device 6 in succession, the constructional units $2_1$ and $2_2$ is advanced step by step. This procedure repeats itself until the constructional unit group arrives at a desired site of installation. During this advancement, the reaction force creating apparatus provided in the intermediate constructional unit $2_2$ is put into operation. This apparatus comprises a jack supporting member 8 on which jacks $9_1$ and $9_2$ are mounted, and movable support plates $10_1$ and $10_2$ arranged to slidingly protrude from or retract to respective recessed portions formed in parts of the periphery of the intermediate constructional unit $2_2$ and connected to the respective jacks $9_1$ and $9_2$. As the jack supporting member 8 serves as the reaction force receiver, the individual operations of the horizontally opposed jacks $9_1$ and the vertically opposed jacks $9_2$ causes the strong contact of the respective movable support plates $10_1$ and $10_2$ against the ground wall 1, thereby very large frictional forces are produced which are converted through the internal surface engagement of the individual movable support plates $10_1$ and $10_2$ with the recessed portions of said intermediate constructional unit $2_2$ to a reaction force with a magnitude necessary to advance the forwardmost constructional unit $2_1$ relative to the ground while excavating the front surface of a tunnel. This reaction force which is very strong and can be produced reliably with a magnitude previously computable is combined with an uncertain reaction force based on the sum of uncertain frictional forces of the individual constructional units $2_2$ and $2_3$ against the adjacent walls of the ground with uneven pressure force. By utilizing this combined reaction foces, and by operating the propulsion jack $3_1$, the steady excavation advancement of the forwardmost constructional unit $2_1$ can be achieved.

EXAMPLE IX

In the preceding examples, the method and apparatus for advancing a plurality of longitudinally arranged movable constructional units forwardly successively in a self-running manner according to the present invention. The present example shows a modification in which the linking member is shifted backward without supplementing the required length of the linking member when additional constructional units are added to the rear end of the linked constructional units.

Thus as shown in FIG. 25A, the linking member 3 is shifted to the linked constructional units $1_2 - 1_4$ from the linked constructional units $1_1 - 1_3$ when the constructional unit $1_4$ is added to the rear end of the linked units so as to advance the unit $1_1$. In this modification, the length of the linking member may be constant and thus it is not necessary to supplement the linking member and the joints for the linking member in spite of the increased number or extension and the constructional unit assembly. The principle and operation of the modification are same as in the preceding examples. In the drawings, $1_1 - 1_4$ are respectively a constructional unit. $2_1 - 2_3$ are respectively a jack, 3 is a linking member, 4 is a jack connected to the linking member, 5 is an anchor of one side and 6 is an anchor of the other side.

In the above-described Examples I to IX, the principles of the present invention and its embodiments and modifications have been explained. However, the present invention is not limited only to the examples of the embodiments and modification mentioned above, and various changes in design may be made without departing from the scope of the present invention described in the appended claims.

What is claimed is:

1. A method of advancing a plurality of longitudinally aligned movable constructional units successively in a self-running manner, wherein said constructional units constituting an underground structure of a form adapted for a special purpose such as tunnel excavation, heavy load transportation, underwater tunnel construction or muddy water dredging excavation are arranged along a common longitudinal line adjacent to each other and are provided with a self-run forward advancement impelling mechanism, said mechanism comprising propulsion means each positioned between adjacent said constructional units, a linking member extending over the entire length of said constructional unit group, traction means positioned in front of the forwardmost constructional unit for forward advancement thereof and connected to said linking member, and anchorage members arranged for selective contact with the respective intermediate and tailing ones of said constructional units and mounted on and selectively engageable with said linking member, said method comprising actuating the first one of said propulsion means positioned between the forwardmost and next ones of said constructional units while releasing said traction means and all the said anchorage members from engagement with said linking member to advance said forwardmost constructional unit relative to said next constructional unit and to the ground, releasing said first propulsion means, bracing said linking member to said next constructional unit through the one of said anchorage members arranged for selective engagement therewith, actuating said traction means and the second one of said propulsion means positioned between the second and third ones of said constructional units counting from the front to advance said next constructional unit relative to the ground, advancing the other ones of said intermediate constructional units individually subsequently in a manner similar to that described above relative to the ground, bracing said linking member to said tailing constructional unit through the one of said anchorage members arranged for selective contact therewith, actuating said traction means to advance said tailing constructional unit relative to the ground through said linking member, and repeating the procedure consisting of the above-described steps a necessary number of times.

2. A method of advancing a plurality of longitudinally aligned movable constructional units successively in a self-running manner by the use of the self-run forward advancement impelling mechanism of claim 1 of a modifiifcation such that instead of using an anchorage member as arranged behind the rear face of said tailing constructional unit for bracing engagement therewith, said advancing means is used as arranged for cooperation with said linking member, and instead of using said traction means as arranged before the front face of said forwardmost constructional unit for cooperation with said linking member, an anchorage member is used as arranged thereat, said method comprising actuating the first one of said propulsion means positioned between the forwardmost and next ones of said constructional units while releasing said advancing means to advance said forwardmost constructional unit relative to said next constructional unit and to the ground, releasing said first propulsion means, bracing said linking member between said forwardmost and said tailing constructional units, actuating the second one of said propulsion means positioned between the second and third ones of said constructional units counting from the front to advance said second constructional unit relative to the ground, and finally actuating said advancing means while releasing the last one of said propulsion means to advance said tailing constructional unit relative to the ground through said linking member.

3. A method of advancing a plurality of movable constructional units successively in a self-running manner according to claim 2, wherein between said adjacent constructional units and between the front end of said forwardmost constructional unit and a cutter are positioned respective propulsion members, and a linking member serving as a part of a bracing-and-advancing facility is provided as arranged to pass through a cutter-supporting member and said tailing constructional unit, the other part of said bracing-and-advancing facility being constituted of a propulsion on traction jack mounted at one end of said linking member, the opposite end of which is associated with an anchoring member, thus constituting a self-run advancement impelling mechanism, said method comprising actuating the one of said propulsion member while releasing said bracing-and-advancing facility or said anchoring member to advance said cutter relative to the said forwardmost constructional unit, bracing said cutter to said tailing constructional unit by said bracing-and-advancing facility, actuating the one of said propulsion members between said forwardmost and the next one of said constructional units while releasing said first propulsion member to advance said forwardmost constructional unit relative to the ground, advancing the other intermediate ones of said constructional units individually successively in a manner similar to that described above, and finally advancing said tailing constructional unit relative to the ground by said bracing-and-advancing facility through said linking member.

4. A method of advancing a plurality of movable constructional units successively in a self-running manner according to claim 2, wherein between a divided cutter constructed as slidingly movable around the periphery of a movable support frame and said forwardmost constructional unit, and between the adjacent constructional units are respective propulsion jacks, and a bracing-and-advancing interconnection member passing between said movable support frame and said tailing constructional unit is provided with a bracing-and-advancing facility constituted mainly of a propulsion or traction jack mounted at one end thereof and with an anchoring member mounted at the other end thereof; with this construction, after a joining member is detachably mounted between an impelling member existing in front of a first propulsion jack mounted in front of said forwardmost constructional unit and each divided cutter to establish engagement therewith, by said first propulsion jack, the divided cutter is advanced successively in repeat, after all the cutter has been advanced, each joining member is inserted between said movable support frame and divided cutter to fixedly support the both parts in unison, next the movable support frame and the tailing constructional unit are braced by both the above mentioned bracing-and-advancing facility and the anchoring member, then the propulsion jacks between the successive constructional units are individually subsequently operated to advance the constructional units forwardly in succession beginning with the forwardmost constructional unit, the tailing constructional unit being advanced forwardly by the above mentioned bracing-and-advancing facility through the linking member, then said bracing-and-advancing facility and the engagement between the movable support frame and divided cutter are released, then the first advancing jack is operated to advance a movable support frame provided with a soil-retaining jack, and repeating the above mentioned procedure a necessary number of times.

5. A method of advancing a plurality of movable constructional units forwardly successively in a self-running manner as described in claim 1, wherein a transportation structure unit group as the plurality of constructional units, each transportation structure unit being constituted of a heavy load carriage and advancing means, is provided with a common linking member arranged to pass therethrough and having anchoring members detachably mounted at the respective ends thereof; with this arrangement, the advancing means provided on the forwardmost transportation structure unit is operated to advance said transportation structure unit forwardly by a distance of transportation of one stroke relative to the ground, then said advancing means is released, then the next transportation structure unit is advanced by operating the advancing means provided thereon, and repeating the above mentioned procedure a number of times to advance the train of the transportation structure units forwardly relative to the ground through a desired distance.

6. A method of advancing a plurality of movable constructional units forwardly successively in a self-running manner as described in claim 2, wherein said plurality of movable constructional units are a plurality of a longitudinally arranged working platform car units which serve also for construction of a railway; between the successive car units and on the forwardmost or tailing car unit are respective hollow core or full core jacks; a plurality of linking members are arranged to pass through all the car units and each is provided with anchoring members mounted at the respective ends thereof, thereby all the car units are releasably interconnected with each other to a train of platform car units; further, on the upper surface of each of the car units is fixedly mounted operation rails; between the adjacent platform car units, are slidably arranged protection sheaths in a manner to correspond to the variation of the splits of their joint sections as they advance individually; on the surface of each of said protection sheaths, are mounted special interconnection rails interconnecting the above mentioned fixedly mounted operation rails, the rear ends of said operation rails fixedly mounted on the tailing platform car unit being slidably engaged through said special interconnection rails to the already laid rails behind it; after two of the rails for construction of a railway previously stored in the chamber of said tailing platform car unit are extracted to be connected with the respective laid rails, the jack between the forwardmost and next platform car units is operated to advance said forwardmost platform car unit by a distance of one stroke by utilizing the summed reaction forces of all the other platform car units while permitting the protection sheath connected to the forwardmost platform car unit and the special interconnection rails mounted thereon to move slidingly on the upper surface of the next platform car unit together with said forwardmost platform car unit, then all the other but the tailing platform car units are advanced individually subsequently each by the distance of one stroke in a manner similar to that shown above while releasing the one of the jacks which has been used to advance the front adjacent platform car unit by utilizing all the reaction forces of the other platform car units which are summed up by the linking members through the anchoring members mounted at the respective ends thereof, then the tailing platform car unit is advanced by operating the jack mounted on the forwardmost or tailing platform car unit after the one of the jacks which has been operated to advance the last but one car unit is released while utilizing the summed reaction forces of the platform car units fixedly interconnected by the linking members and arranged before the tailing pltform car unit; the special interconnection rails connected with the fixedly mounted rails on the tailing platform car unit are moved with their rear ends being moved on the already laid railway in sliding relation thereto and being advanced forwardly while maintaining the communication with the railway; because of the connection of the rail being laid at their rear ends with the laid railway, as the tailing platform car unit advances forwardly, they are entracted from the chamber of said platform car unit and left behind to be laid; then the above mentioned procedure of the steps repeats itself so that all the working platform car units advance in a self-running manner while automatically laying rails to extent the railway.

7. A method of advancing a plurality of movable constructional units successively in a self-running manner as described in claim 1, wherein said plurality of movable constructional units are a plurality of longitudinally arranged tubular constructional units and another plurality of or a single tubular constructional units or unit opposedly disposed with each other along a common longitudinal line and which are to be advanced toward each other; the former plurality of constructional units are provided with forward advancement jacks arranged between the successive constructional units and with a linking member arranged to pass through all the constructional units and having a forward advancement jack and fixing member mounted at the respective ends of the linking member, thereby all the constructional units are organically interconnected; between said constructional unit group and the other constructional unit arranged in opposed relation thereto, is another traction member arranged to longitudinally pass therebetween; said traction member is connected with said constructional unit group by a dismountable fixing member; the traction member and said opposite side constructional unit are organically combined with each other by a traction jack and fixing member provided on said constructional unit; by operating the forward advancement jack between the forwardmost and next units of said constructional unit group while fixing the dismountable fixing member provided on said forwardmost constructional unit and by operating the traction jack provided on the opposite side constructional unit, said forwardmost constructional unit is advanced by propulsion and traction by utilizing the summed reaction forces of all the constructional units but the forwardmost one and of the opposite side constructional unit; such a procedure is repeated to advance said constructional unit group is a self-running manner with application of traction force thereto; and on the other hand, while the fixing members detachably mounted on the individual constructional units of said group are fixed, the traction jack provided on the opposite side constructional unit is operated to move said opposite side constructional unit by utilizing all the reaction forces of the individual constructional units of said group.

8. A method of advancing a plurality of movable constructional units successively in a self-running manner as described in claim 2, wherein instead of said constructional unit arranged as opposed to said constructional unit group, an anchorage is arranged as opposed thereto; said anchorage and said constructional unit group are combined by a traction member so that the anchorage, traction jack, traction member, fixing members and the above mentioned organically self-runningly constituted constructional unit group are organically combined with one another, thereby said constructional unit group is continuously advanced with excavation in such a manner as to apply even traction force to said constructional unit group.

9. A method of advancing a plurality of movable constructional units forwardly successively in a self-running manner as described in claim 2, wherein a plurality of constructional units for construction of a tunnel are arranged along a common longitudinal line on a protrusion station located under water or on land provided with propulsion jacks, linking members, a traction or propulsion jack advancing facility and fixing members arranged to constitute a self-running advancement control mechanism by which said constructional unit group is organically operated; between the adjacent constructional units, are water-proof shielding sleeve means, said adjacent joining sections are provided with split-measuring instruments and vertical and horizontal shift-measuring instruments arranged in cooperation with the propulsion jacks and with the jack advancing facility to permit the remote control from said protrusion station; with this arrangement, the one of the propulsion jacks which is positioned between the forwardmost and next constructional units is operated to advance said forwardmost constructional unit on a previously laid and levelled foundation from said protrusion station into a body of water through a length of one stroke relative to the foundation while utilizing the summed reaction forces of said second and third constructional units, then such a procedure is repeated to advance the second and other constructional units that follow individually subsequently step by step each through the length of one stroke into the water body until said constructional unit group as a whole is advanced by a length equal to the entire length of one constructional unit, then an additional constructional unit provided with propulsion jack is added to the rear end of said tailing constructional unit in end-to-end contacting relation on the protrusion station while said linking member is extended to pass through said additional constructional unit, then the dismountable fixing member or jack advancing facility is displaced from the tailing constructional unit to the additional construction unit along with the provision of a water-proof shielding sleeve means and one set of the above mentioned measuring instruments, then said constructional unit group together with said additional constructional unit is advanced in a manner similar to that described above, whereby said constructional unit group is successively extended to a predetermined length while advancing on the foundation in a self-running manner under the remote control from the land and permitting the entrance of water into the interior of the constructional unit group, and then a tunnel structure extended into water and having a predetermined length is advanced infinitely to a desired site of installation.

10. A method of advancing a plurality of movable constructional units forwardly successively in a self-running manner as described in claim 9, wherein, there are provided a water-tight pressure device mounted in the front portion of the forwardmost constructional unit to maintain the interior of the constructional unit group in a non-water state despite of the fact that it is submerged, and a ballast compartment containing ballast, a part of which may be water, and which counteracts the buoyancy effect of the water to prevent the floating-up of the constructional unit group as it is in the body of water; with this arrangement, the first propulsion jack is operated to advance the forwardmost constructional unit into the water body on a previously laid and levelled foundation through a length of one stroke while utilizing the summed reaction forces of the second and third constructional units, then the above-described procedure is repeated until an underwater tunnel structure of a desired length is installed at a desired site.

11. A method of advancing a plurality of movable constructional units forwardly successively in a self-running manner as described in claim 9, wherein for construction of an underground structure by advancement and excavation in a water-pressure acting ground, a plurality of constructional units are arranged along a common longitudinal line to be movable in one direction; between the successive constructional units, are respective propulsion jacks, and there is provided a linking member arranged to pass through all the constructional units and having a fixing member mounted at one end thereof, the opposite end of which is associated with a jack advancing facility, thereby all the constructional units are interconnected; with this arrangement, a compressed air chamber for the work provided at the front end of the forwardmost constructional unit, a compressed air buffering chamber located in the rear thereof, and a compressed air producing chamber located adjacent thereto are put in order and distributed in a minimum area to correlate the functions of these three chambers with each other in such a manner that a compressed air produced in the compressed air producing chamber is applied to the compressed air buffering chamber in which the air pressure adjustment is performed to maintain the air pressure of the compressed air chamber for the work at a constant level relative to the outside atmospheric pressure; while excavating by the cutter blades in the compressed air chamber for the work, the constructional unit group is advanced in a manner similar to that shown in claim 9, whereby the above-described three chambers necessary for production of a compressed air are simultaneously advanced forwardly to infinite as the constructional unit group advanced forwardly to infinite to achieve the advancement and construction of the underground structure directly in the water pressure-acting ground while employing the compressed air excavation technique.

12. A method of advancing a plurality of movable constructional units forwardly successively in a self-running manner as described in claim 2, wherein for construction of an underground structure from the constructional unit group advanced by excavation in a soft sandy ground, a necessary number of constructional units are arranged in one direction in the ground; between the successive constructional units are respective propulsion jacks, and a linking member is arranged to pass through all the constructional units and is provided with a fixing member mounted at one end thereof and with a jack advancing facility mounted at the opposite end thereof, whereby all the constructional units are interconnected, with this arrangement, various equipments necessary for the known excavation technique using water jet are provided in a front portion of the forwardmost constructional unit, and separating means for separating out water from a muddy water boot is provided as arranged in the ones of the constructional unit group which follow the forwardmost constructional unit; after the constructional unit group has been advanced in a self-running manner by one step, the front face of the tunnel is excavated, then a pressure water jet is applied thereto to convert the spoil into a muddy water body which is pumped to the separating means, the water separated from the muddy water body being either recirculated to a water jetting means, or discarded to the outside of the constructional unit group, and the other part of soil being conveyed to the outside of the constructional unit group, and then the constructional unit group is advanced by one step in a manner similar to that described in claim 2, whereby an underground structure is constructed from the constructional unit group advanced directly in the soft sandy ground at a desired site of installation.

13. A method of advancing a plurality of movable constructional units forwardly successively in a self-running manner as described in claim 2, wherein for construction of an underground structure from a constructional unit group advanced by excavation in a hard ground, a plurality of constructional units are arranged along a common longitudinal line to be movable in one direction; between the successive constructional units are respective jacks and a linking member is arranged to pass through all the constructional units and provided with a fixing member mounted at one end thereof and with a jack advancing facility mounted at the opposite end thereof, whereby all the constructional units are interconnected; the necessary ones of the constructional units but the forwardmost one are provided with respective jack support members each carrying a number of jacks mounted therearound and with cutout portions formed in the respective portions of the peripheral walls of the constructional units containing the jack support members and accommodating therein respective support plates connected to the respective jacks to be movable to protrude from and to retract to the cutout portions in sliding relation thereto, so that when the above-described jacks are operated, the ground surface which is in contact with the outer peripheries of the constructional units containing therein the jack support members serve as the support receiving surface subject to the strong force pressure of said movable support plates, whereby the reaction force necessary for the advancement of the forwardmost or tailing constructional unit is created in part by the frictional forces of the other constructional units against the tunnel ground surface and in part by the bracing forces of the above-described movable support plates against the hard ground surfaces of the tunnel, whereby the constructional unit group is advanced by successively operating the jacks provided between the successive constructional units.

14. A method according to claim 2, in which the linking member is shifted backward when an additional constructional unit is added.

15. An apparatus for advancing a plurality of movable constructional units for construction of an underground structure forwardly successively in a self-running manner comprising a plurality of movable underground constructional units arranged longitudinally in one direction, an advancement linking member passing therethrough, an advancement traction device for said linking member mounted at the front surface of the forwardmost constructional unit, anchoring members selectively engageable with said advancement linking member and with the respective intermediate and tailing constructional units, and propulsion means positioned between the adjacent constructional units.

16. An apparatus for advancing a plurality of movable constructional units forwardly successively in a self-running manner as described in claim 15, wherein in said advancement device for said constructional unit group, advancing means of said advancement linking member is arranged at the rear surface of the trailing constructional unit, and said anchoring member of said advancement linking member is arranged on the forwardmost constructional unit.

17. An apparatus for advancing a plurality of movable constructional units forwardly successively in a self-running manner as described in claim 16, wherein in the advancing device of said constructional unit group, behind a cutter is a plurality of constructional units slidingly engaged with each other, between said cutter and the forwardmost constructional unit is a propulsion device, between said cutter and the rear tailing constructional unit is a brace-and-advancement linking member as passing therethrough, and said brace-and-advancement linking member is provided at the both ends thereof with a bracing-and-advancing equipment constituted of a propulsion jack or traction jack mounted thereon and with a fixing member mounted thereon.

18. An apparatus for advancing a plurality of movable constructional units forwardly successively in a self-running manner as described in claim 16, wherein in the advancing device of said constructional units, there are provided a movable support frame having a soil retention jack mounted at the front and a divided cutter assembled in slidable relation around said movable support frame, between said divided cutter and the forwardmost constructional unit is a propulsion jack, between said movable support frame and the tailing constructional unit is arranged a brace-and-advancement linking member as passing therethrough, and between a pushing member contacting with the front end of the propulsion jack before the forwardmost constructional unit and the divided cutter and between said divided cutter and the movable support frame are detachably mounted respective joining members.

19. An apparatus for advancing a plurality of movable constructional units forwardly successively in a self-running manner as described in claim 16, wherein a plurality of heavy load carriages provided with advancing means detachably mounted thereon as transportation apparatus units for transporting heavy loads are arranged along a longitudinal line and are provided with a common linking member arranged to pass through the individual transportation apparatus units, and said linking member is provided with fixing members detachably mounted at the respective ends thereof.

20. An apparatus for advancing a plurality of movable constructional units forwardly successively in a self-running manner as described in claim 16, wherein a plurality of rail laying operation platform cars as the constructional units are arranged along a longitudinal line, between the successive platform car units and on the forwardmost or tailing platform car unit are respective hollow core or full core jacks, a plurality of linking members each having fixing members mounted at the respective ends thereof are arranged to pass through all the platform car units so that all or some of the individual platform car units are either engaged with or disengaged from each other by free choise, whereby a series of interrelated operations can be performed as they are organically constituted; in order to shield the splits between the successive platform car units which are to be formed when the platform car units are individually advanced relative to the next platform car units, there are provided protecting sheaths connected by hinge structures at the front ends thereof to the rear ends of the respective front ones of the successively paired adjacent platform car units, and having special interconnection rails mounted on the upper surfaces thereof and arranged to interconnect the operation rails fixedly mounted on the adjacent front and rear platform car units, the front ends of said special interconnection rails being connected by hinge structure to the rear ends of the operation rails fixedly mounted on the adjacent front platform car unit, and its entire cross-sectional area has a form such that the special interconnection rails are maintained in sliding engagement with the operation rails on the adjacent rear platform car unit to permit the passage of working tractors thereon, whereby the working tractors can always pass on the operation platform car unit group as the platform car units are advanced individually while shielding the splits thereby formed between the successive platform car units.

21. An apparatus for advancing a plurality of movable constructional units forwardly successively in a self-running manner as described in claim 16, wherein a plurality of underground structure constructional units on one side and a plurality of, or a singular number of constructional units or unit are arranged along a common longitudinal line in opposedly disposed relation to each other; the constructional unit group on the one side is constructed in a manner to be capable of performing the above mentioned self-runningly advancing method, and there is provided a traction member arranged to pass between said constructional unit group and said opposite side constructional unit and having fixing members detachably mounted between said traction member and the individual constructional units of said group, that portion of said traction member which passes through the opposite side constructional unit being organically connected to said traction member through a traction member and fixing member mounted at the rear end of said opposite side constructional unit.

22. An apparatus for advancing a pluality of movable constructional units forwardly successively in a self-running manner as described in claim 21, wherein the opposite side one constructional unit is replaced by an anchorage, and between this anchorage and said constructional unit group is arranged a traction member as passing therethrough, the traction member being provided with a traction jack and with dismountable fixing members arranged thereon at respective locations corresponding to those of the individual constructional units, whereby the anchorage, traction jack, traction member and dismountable fixing members are organically, interrelated with each other to constitute a mechanism which is associated with said apparatus.

23. An apparatus for advancing a plurality of movable constructional units forwardly successively in a self-running manner as described in claim 22, wherein the constructional unit group is provided with advancing jack means arranged at the front face of the forwardmost constructional unit which faces the anchorage.

24. An apparatus for advancing a plurality of movable constructional units forwardly successively in a self-running manner as described in claim 16, wherein there are provided a plurality of underwater structure contructional units, propulsion jacks between the successive constructional units, a linking member passing through the interior or exterior of said constructional units, and jack advancing facility and dismountable fixing members arranged at the respective ends of the linking member, whereby said constructional units are organically interconnected; and there are further provided between the adjacent constructional units respective water-proof protection sleeves having split-measuring instruments and vertical-and-horizontal shift-measuring instruments, and a remote control device located on a protrusion station.

25. An apparatus for advancing a plurality of movable constructional units forwardly successively in a self-running manner as described in claim 24, wherein the peripheries of the joint sections between the successive constructional units are covered with respective water-proof protection sleeve devices, the water-proof protection sheets for preventing entrance of soil or water provided on said water-proof protection sleeve devices extend so as to cover the splits formed at said joint sections and are fixedly mounted at the front ends thereof through respective water-proof members on the rear end portions of the front ones of the successively paired adjacent constructional units, the rear ends of said protection sheets overlapping the front portions of the adjacent rear constructional units through water-proof flexible ring members which are brought into water-tightly contacting relation around the entire peripheries of the front portions of the adjacent rear constructional units under the action of outside water pressure, whereby said water-proof protection sheets and water-proof flexible ring members are slidingly moved over the entire peripheries of the front portions of the adjacent rear constructional units, and there are further provided a water-proof device mounted at the front face of the forwardmost constructional unit and various ballast compartments located interior or exterior of the constructional units.

26. An apparatus for advancing a plurality of movable constructional units forwardly successively in a self-running manner as described in claim 24, wherein and there are further provided a compressed air chamber for the work arranged at the front end of the forwardmost constructional unit, in the rear thereof is an air pressure buffering chamber having mounted therein an air pressure adjusting equipment for the operator passage and another air pressure adjusting equipment for the spoil passage, and further adjacent thereto is a compressed air producing chamber having mounted therein a compressed air generating machine, the above mentioned three chambers being organically communicated with each other, whereby as the constructional unit group advances forwardly, the three chambers are advanced forwardly in a forced self-running manner.

27. An apparatus for advancing a plurality of movable constructional units forwardly successively in a self-running manner as described in claim 24, wherein and there are provided a pressure bulkhead fixedly mounted at a location in the front portion of the forwardmost constructional unit over the entire cross-sectional area thereof, a muddy water chamber formed between said bulkhead and cutter blades in which the excavated soil is converted to a muddy water body, and a set of various means necessary for muddy water jet excavation such as pressure water jetting means, muddy water pumping means and muddy water settling means fixedly mounted behind said bulkhead in the interior of the necessary ones of the constructional units, whereby as the constructional unit group advances forwardly in a self-running manner, these various facilities are advanced forwardly in a passive manner.

28. An apparatus for advancing a plurality of movable constructional units forwardly successively in a self-running manner as described in claim 24, wherein and the necessary ones of the constructional units which follow the forwardmost constructional unit are provided each with a jack-supporting ring having mounted thereon, a number of jacks, with movable support plates arranged in respective cutouts formed in portions of the peripheral walls of the constructional units to be protrusible therefrom and retractable thereto in sliding relation to the internal peripheries of the cutouts so that the support plates in the protruded position are braced against the tunnel surface and with a linking mechanism positioned between the support plates and the jacks of the jack-supporting ring.

29. A method of advancing a plurality of longitudinally aligned movable constructional units successively in a self-running manner, wherein said constructional units constituting an underground structure of a form adapted for a special purpose such as tunnel excavation, heavy load transportation, underwater tunnel construction or muddy water dredging excavation are arranged along a common longitudinal line adjacent to each other and are provided with a self-run forward advancement impelling mechanism, said mechanism comprising propulsion means each positioned between adjacent said constructional units, a linking member extending over the entire length of said constructional unit group, traction means connected to said linking member, and anchorage members arranged for selective contact with said constructional units and mounted on and selectively engageable with said linking member, wherein the method comprises the steps of actuating the first one of said propulsion means positioned between the forwardmost and the next one of said constructional units while releasing said anchorage members for advancing said forwardmost constructional unit relative to said next constructional unit and to the ground, releasing said first propulsion means, bracing said linking member to said constructional unit by means of the respective anchoring member, actuating the second one of said propulsion means positioned between the second and third ones of said constructional units counting from the forwardmost one thereof for advancing the second constructional unit relative to the ground, and advancing the remaining ones of said constructional units individually subsequently in a manner similar to that described above relative to the ground, and repeating the procedure consisting of the above-described steps the number of times necessary for effecting the desired longitudinal movement of the constructional units.

30. An apparatus for advancing a plurality of movable constructional units for construction of an underground structure forwardly successively in a self-running manner comprising a plurality of movable underground constructional units arranged serially longitudinally in one direction, an advancement linking member passing through said constructional units, an advancement traction device associated with said linking member and mounted thereon at one end of said linking member, anchoring members mounted on and selectively engageable with said linking member and arranged to engage at least certain ones of said constructional units, and propulsion means positioned between adjacent said constructional units.

* * * * *